US009242139B2

(12) United States Patent
Holley

(10) Patent No.: US 9,242,139 B2
(45) Date of Patent: Jan. 26, 2016

(54) WHOLE BODY EXERCISE APPARATUS FOR USE WITH ELASTIC SPHERICAL BALL

(76) Inventor: Terry Reed Holley, Stayton, OR (US)

( * ) Notice: Subject to any disclaimer, the term of this patent is extended or adjusted under 35 U.S.C. 154(b) by 799 days.

(21) Appl. No.: 12/954,593

(22) Filed: Nov. 24, 2010

(65) Prior Publication Data

US 2011/0124476 A1 May 26, 2011

Related U.S. Application Data

(60) Provisional application No. 61/264,029, filed on Nov. 24, 2009.

(51) Int. Cl.

| | |
|---|---|
| ***A63B 23/02*** | (2006.01) |
| *A63B 21/055* | (2006.01) |
| *A63B 43/00* | (2006.01) |

(52) U.S. Cl.

CPC ..... *A63B 23/02* (2013.01); *A63B 21/0557* (2013.01); *A63B 23/0211* (2013.01); *A63B 23/0216* (2013.01); *A63B 43/00* (2013.01); *A63B 2210/50* (2013.01)

(58) Field of Classification Search

USPC ..... 482/140–142, 57, 121–129, 148

See application file for complete search history.

(56) References Cited

U.S. PATENT DOCUMENTS

| | | | | |
|---|---|---|---|---|
| 3,501,140 | A * | 3/1970 | Eichorn | 482/130 |
| 4,470,408 | A * | 9/1984 | Gordon | 482/144 |
| 4,620,704 | A | 11/1986 | Shifferaw | |
| 4,827,535 | A * | 5/1989 | Socey | 2/158 |
| 5,112,043 | A * | 5/1992 | Gilfillian, Jr. | 482/53 |
| 5,145,472 | A * | 9/1992 | Johnson et al. | 482/37 |
| 5,261,868 | A * | 11/1993 | Pryor et al. | 482/142 |
| 5,632,708 | A * | 5/1997 | Wilkinson et al. | 482/52 |
| 5,833,587 | A | 11/1998 | Strong et al. | |
| 5,967,955 | A | 10/1999 | Westfall et al. | |
| 6,309,331 | B1 | 10/2001 | Raymond | |
| 6,375,601 | B1 * | 4/2002 | Johnson | 482/142 |
| 6,461,284 | B1 | 10/2002 | Francavilla | |
| 6,478,721 | B1 | 11/2002 | Hunter | |
| 6,601,745 | B2 * | 8/2003 | Tyrer | 224/274 |
| 6,616,238 | B1 * | 9/2003 | Guery-Strahm | 297/452.41 |
| 6,692,418 | B2 * | 2/2004 | Shahan | 482/144 |
| 6,746,372 | B2 | 6/2004 | Hsu | |
| 7,118,517 | B1 * | 10/2006 | Hale | 482/140 |
| 7,311,644 | B2 | 12/2007 | Hale | |
| 7,476,189 | B2 | 1/2009 | Hale | |
| 7,699,756 | B2 * | 4/2010 | Piane, Jr. | 482/38 |
| 8,052,586 | B2 * | 11/2011 | Hahn | 482/142 |
| 8,235,877 | B2 * | 8/2012 | Boren | 482/142 |

(Continued)

*Primary Examiner* — Stephen Crow

(74) *Attorney, Agent, or Firm* — James L. Lund, Esq

(57) ABSTRACT

Disclosed is an exercise apparatus for use in developing strength and flexibility in all muscular groups of a person's core as well as the major muscle groups of in the arms, legs and neck. The device uses an elastic ball and ball support to evenly distribute contact forces between the person's body and the device while preventing ball motion during stretching, exercising, and physical therapy. The exercise apparatus also comprises a torso support and a foot ladder to that are configured to provide stability and comfort to a user while enabling the user to undertake a multitude of optimal stretching, exercising and rehabilitation regimens. Additionally, the device may be used with free weights or elastic members. In some embodiments the exercise device further comprises elastic members comprised of elastic straps, wherein the exercise apparatus is configured to provide resistance directions, planes of motion, and range of motion to a user that are not achievable with other devices.

15 Claims, 24 Drawing Sheets

(56) References Cited

U.S. PATENT DOCUMENTS

2004/0180768 A1* 9/2004 Almada ..... 482/142
2005/0079964 A1* 4/2005 Francavilla ..... 482/142
2005/0143235 A1* 6/2005 Park ..... 482/142
2010/0048368 A1* 2/2010 Donofrio ..... 482/130
2014/0274571 A1* 9/2014 Aral Diaz ..... 482/37

* cited by examiner

WHOLE BODY EXERCISE APPARATUS FOR USE WITH ELASTIC SPHERICAL BALL

RELATED APPLICATION DATA

This application claims priority from U.S. provisional application Ser. No. 61/264,029 filed Nov. 24, 2009, that we incorporate by reference.

FIELD OF THE INVENTION

The present invention relates to exercise devices that are used for stretching, strengthening, conditioning, and physical therapy.

BACKGROUND OF THE INVENTION

Large inflatable exercise balls have been available to the public for quite some time, and are commonly used in fitness routines, such as those involving yoga or pilates. A user basically sits on the ball and stretches or exercises. Such exercise, however, generally requires a great degree of balance to prevent accidental injury caused by the ball rolling out from under the user. In addition, because the ball is not prevented from rolling or rotating, only a limited number of exercises can be done with such a ball, even by the experienced user.

Therefore, what is needed is an exercise apparatus that does not rotate or react with universal motion when forcibly contacted by an individual, but rather one that translates the these reaction forces imposed by the stretching and/or exercising individual into static frictional forces that automatically maintain the stability of the exercising individual.

BRIEF DESCRIPTION OF THE INVENTION

The present disclosure solves many of the disadvantages associated with existing exercise devices. The present exercise apparatus utilizes the unique elastic properties of a pliable spherical ball while preventing ball motion, thereby providing comfortable support to a user.

An exercise apparatus is herein disclosed as comprising a ball support configured to receive an elastic ball, an angled foot ladder configured to receive one or more feet of a user, wherein the foot ladder is attached to one end of the ball support and is configured to provide rigid support to the user, and a torso support configured to support the torso of the user during exercise, wherein the torso support is attached to another end of the ball support.

An exercise apparatus is herein disclosed as comprising a ball support configured to receive an elastic ball, a foot ladder configured to receive one or more feet of a user, wherein the foot ladder is attached to one end of the ball support and is configured to provide rigid support to the user, and an elastic member having a first end, a second end, and a midpoint region, wherein the midpoint region of the elastic member is wrapped over a component of the foot ladder, wherein the first end and the second end of the elastic member are configured to be gripped by a user to generate a resistance force in a resistance force direction.

A system for exercising is herein disclosed as comprising a means for receiving an elastic exercise ball, a torso supporting means, wherein the torso supporting means are configured to support a user's body weight, and wherein the torso supporting means comprise a horizontal surface that is configured to be substantially coplanar with an upper portion of an elastic ball that has been deformed under the weight of a user, and a foot restraint means, wherein the foot restraint means are configured to restrain a user's feet at each of a plurality of degrees of knee bend without interrupting an exercise routine.

BRIEF DESCRIPTION OF THE DRAWINGS

FIG. 10 shows one of the numerous flexibility exercises that can be performed on embodiments of an exercise apparatus. This exercise maximizes vertebral flexion and extension coupled with shoulder stretching.

FIG. 11 shows a modified stretch of the hip flexors and quadriceps while enhancing vertebral extension. As can be seen, these are done from a very optimal biomechanical position.

FIG. 12 shows a progression of stretches beginning with the body supine on the ball. While extending knees and bringing the legs overhead this achieves progressive vertebral flexion and hamstring stretching.

FIG. 13 shows a person supine on the exercise device while performing horizontal adduction exercises.

FIG. 14 shows a person seated on the ball and working the anterior deltoid by shoulder flexion. Note the importance of core stability during this exercise and also the progressive spinal extension occurring with increased shoulder flexion.

FIG. 15 shows curls by working the biceps brachii and brachialis.

FIG. 16 shows shoulder abduction working the middle deltoid and supraspinatus with core stabilization seated on the ball.

FIG. 17 shows multiple exemplary shoulder shrug exercise positions utilizing elastic members attached to various points of a foot ladder.

FIG. 18 shows an exercise with motion occurring between the humerus and scapula (glenohumeral motion).

FIG. 19 shows exercising the posterior spinal extensors with the subject prone on the ball with feet stabilized on a foot ladder.

FIG. 20 shows that by placing the feet higher on the foot ladder than FIG. 19, different forces are transmitted through the spinal extensors.

FIG. 21 shows the subject supine on the ball with the vertebral column supported on the ball. This exercise is commonly called abdominal crunches. By performing this exercise on the ball one gets segmental contraction of the abdominal muscles. By using one or more elastic members, progressive resistance can be placed on the abdominal musculature.

FIG. 22 shows the subject in a prone position with knee on the ball and hands placed on a longitudinal top support of a foot ladder. With one end of an elastic member attached to a ball support and the other end attached around the subject's ankle, the person engages the gluteus maximus and gluteus medius with hip extension and hip hyperextension.

FIG. 23 shows the subject prone on the ball with upper body resting on a torso support. One end of an elastic member is attached to the subject's ankle and the other end is attached to a foot ladder. This isolates the hamstrings during knee flexion.

FIG. 24 shows the subject supine on an embodiment of the exercise apparatus with back supported on a torso support. Beginning with hip hyperextended, the subject engages in hip flexion working the hip flexors (iliacus and psoas major).

DETAILED DESCRIPTION

Figure 1:
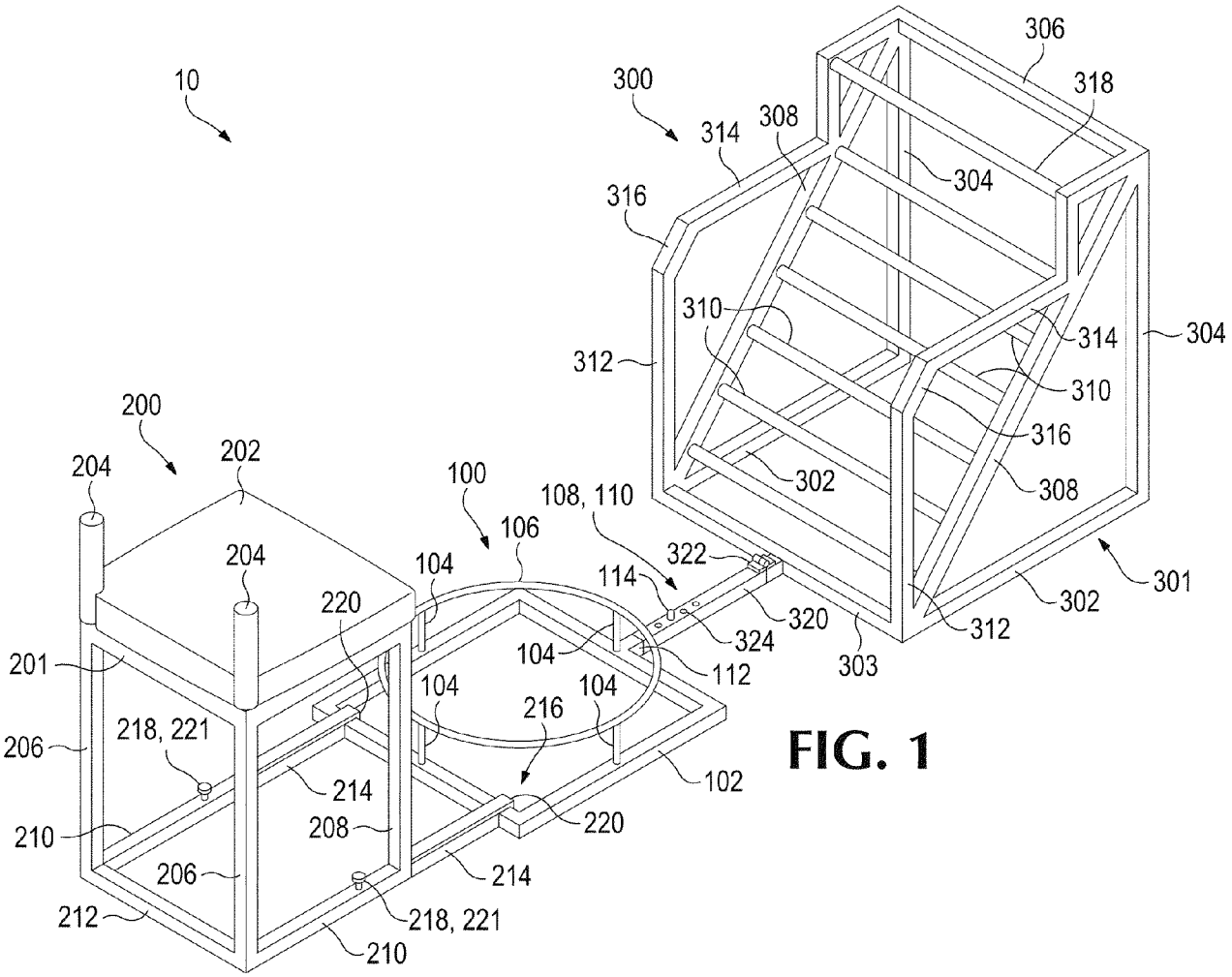
FIG. 1 shows a perspective view of an embodiment of the exercise apparatus.

In the drawings like reference numerals generally designate identical or corresponding parts throughout the several views.

Exercise Apparatus

Figure 2:
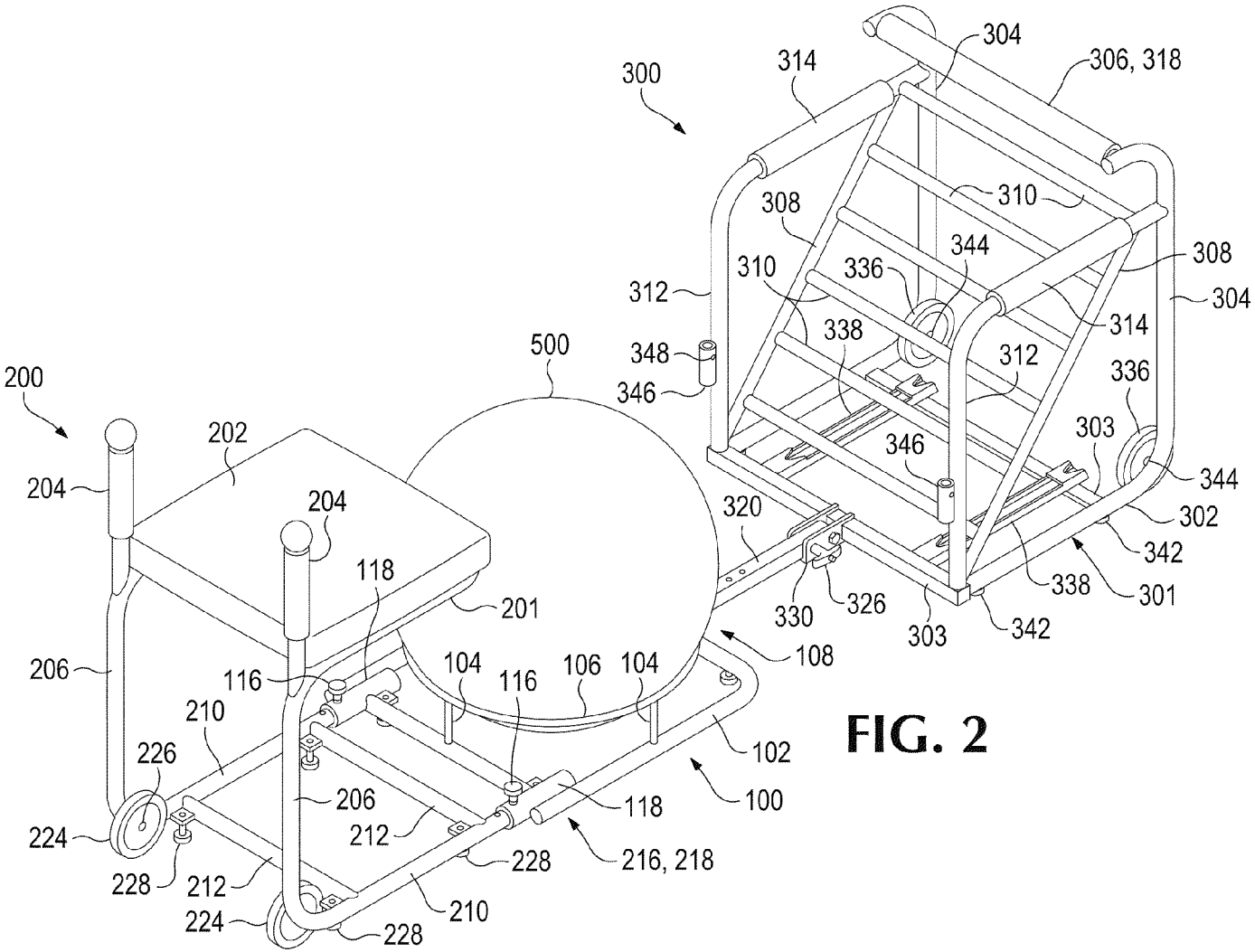
FIG. 2 shows a perspective view of another embodiment of the exercise apparatus.

Referring now to FIG. 1 and FIG. 2, there are shown two exemplary embodiments of an exercise apparatus 10. In general, exercise apparatus 10 comprises a ball support 100, which is configured to support an elastic exercise ball 500 (shown in FIG. 2), situated between a torso support 200 and a foot ladder 300. The elastic ball provides a unique interface with a user that allows the gravity force of an individual to be transferred from the individual's body over an area of the individual's body into the ground while evening out the contact stress, or force per unit area, over an area of the user's body. The exercise apparatus 10 has a bottom upon which it rests.

Many means for supporting the exercise ball are contemplated. For example, the ball support 100 may comprise a ball support ring 106 located vertically above a ball support base 102 by a number of ball support lifters 104. The ball support ring 106 holds the elastic exercise ball 500 so that it does not rotate and is stable during exercises. The major diameter of the ball support ring 106 may be sized to support elastic exercise balls of different diameters. Although four ball support lifters 104 are shown, any number of ball support lifters 104 may be used. In addition, in an embodiment, the ball support lifters 104 are adjustable in height to provide an exercise surface either further from the floor or closer to the floor. Alternately, ball support means comprising a ball support ring 106 may be made integral with the ball support base 102 by having, for example, an overall conical shape whereby the upper rim of the conical shape is configured to support an exercise ball and the lower rim of the conical shape rests on the floor.

Figure 7A:
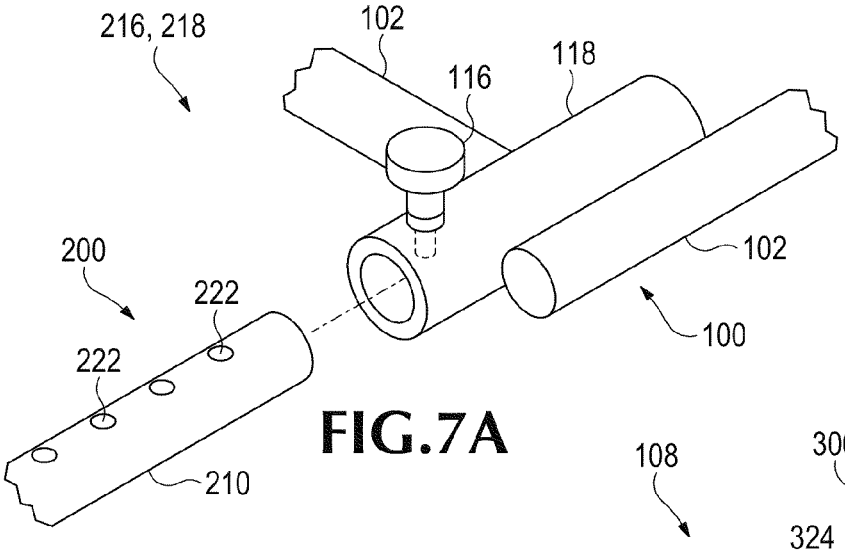
FIG. 7A shows an auxiliary view of an exemplary torso support attachment and adjustment mechanism.

The ball support 100 also comprises means for connecting to the torso support 200. The torso support connection means comprises a torso support attachment mechanism 216. In the embodiment of FIG. 1, the torso support attachment mechanism 216 comprises of two rigid hook-shaped members 220 that are attached to two longitudinal base members 210 of the torso support 200. The torso support attachment mechanism 216 captures the ball support base 102 and locks the torso support 200 in place with respect to the ball support 100. Another torso support connection means comprises a torso support connection mechanism 216 comprising a spring loaded connector pin 116 attached to a first sleeve 118, which is rigidly attached to the ball support base 102, as shown in the exemplary embodiment of FIG. 2, as well as FIG. 7A. Other means for connecting to the torso support 200 include those composed of hinges, fasteners, and spring-loaded detent mechanisms, for example. In many embodiments, the distance between the ball support 100 and the torso support 200 may be adjusted with a torso support adjustment mechanism 218. In the exemplary embodiment of FIG. 1, the distance between the ball support 100 and the torso support 200 is adjusted by axially sliding telescoping torso support connector arms 214 within longitudinal base members 210 and setting the distance with set screw 221. In the exemplary embodiment of FIG. 2, the distance between the ball support 100 and the torso support 200 is adjusted by lifting the spring loaded connector pins 116 so that each pin disengages one of a plurality of adjustment holes 222 in the longitudinal base member 210, rotating the head of each spring loaded connector pin 116 clockwise to hold the pin in the retracted position, axially sliding the longitudinal base members 210 within first sleeve 118 and locking the ball support 100 relative to the torso support 200 by rotating the head of each spring loaded connector pin 116 counterclockwise to release the spring loaded connector pin 116 so that it reengages another of the plurality of adjustment holes 222 (see also FIG. 7A). Although two torso support attachment mechanisms 216 are shown in each of the exemplary embodiments, embodiments comprising only one torso support attachment mechanism 216 are contemplated as well. This adjustment allows for using the device for multiple types of exercises, and allows people of differing heights to optimally use the device.

The torso support 200 comprises a rigid structure upon which a person's torso rests during exercise. A person lies face up (supine position), face down (prone position), or on his or her side upon the torso support top 202 while exercising. The torso support top 202 is attached to top frame 201, which in turn is attached to legs. The torso support top 202 may comprise a material that cushions a user's body as he or she uses the device. In the embodiments shown, the torso support top 202 is oriented horizontally and is located at a height that is configured to be substantially coplanar with an upper portion of an elastic ball that has been deformed under the weight of a user. In some embodiments, the vertical location of the horizontally oriented torso support top 202 is located from 1 to 5 inches below the height of an undeformed elastic exercise ball 500, wherein the height is defined as the uppermost tangent to the undeformed sphere. In some embodiments the height of the torso support top 202 is adjustable with spring loaded connector pins 116, for example, to achieve this relationship. The exemplary embodiment of FIG. 1 shows a torso support 200 having both rear legs 206 and front legs 208, while the exemplary embodiment of FIG. 2 shows only rear legs 206. Further structural rigidity is provided by lateral base member 212 and longitudinal base members 210. Torso support handles 204 are provided for the user to grip during particular exercises. In addition to supporting a user's body weight, the torso support rigidly withstands reaction forces from stretching and exercising motions, including substantial torsional forces incurred when a user executes diagonal type exercises, such as when laying on his or her back and lifting one leg up at a time while pulling upwards on the diagonally positioned torso support handle 204. The embodiment of FIG. 2 also has torso support wheels 224 that are attached to the junction between the rear legs 206 and the longitudinal base members 210 with torso support wheel axel bolts 226. The torso support wheels 224 are used to move the torso support 200 for nesting with the foot ladder 300 while disassembling the exercise apparatus 10, as will be described in a later section. In addition, the embodiment of FIG. 2 has four torso support feet 228 that are attached to the longitudinal base members 210. It should be noted that other torso support means are contemplated, such as a rigid box structure that is hollow or solid, for example.

The ball support 100 also comprises means for connecting to the foot ladder 300. The foot ladder connection means comprises a foot ladder attachment and adjustment mechanism 108, which, in the embodiment of FIG. 1, comprises telescoping members and a spring-loaded detent mechanism 110. In this embodiment, the distance between the ball support 100 and the foot ladder 300 may be adjusted by laterally compressing one or more protrusions 114 of the spring-loaded detent mechanism 110 and axially sliding telescoping connector arm 112 within a foot ladder connector arm 320 and setting the distance by allowing the one or more protrusions 114 to reset into adjustment holes 324.

Figure 7B:
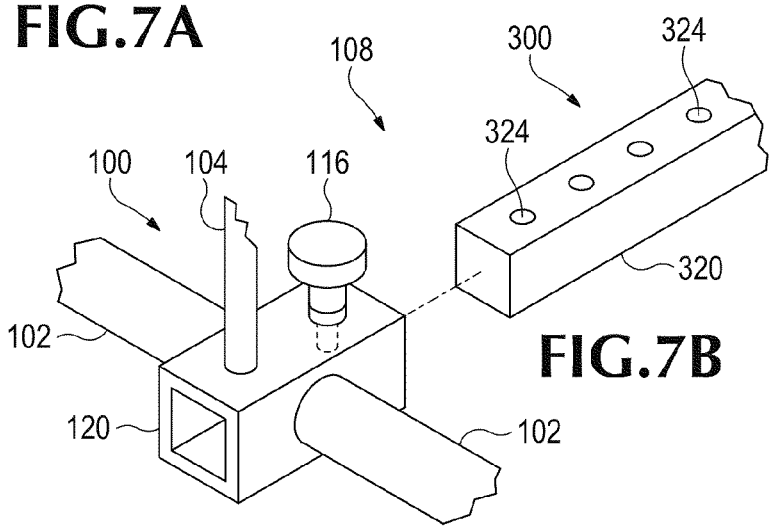
FIG. 7B shows an auxiliary view of an exemplary foot ladder attachment and adjustment mechanism.

In the embodiment of FIG. 2, the foot ladder attachment and adjustment mechanism 108 comprises a spring loaded connector pin 116 attached to second sleeve 120, which is rigidly mounted to the ball support base 102 (see also FIG. 7B). A foot ladder connector arm 320 is configured to slide within second sleeve 120 and spring loaded connector pin 116 releasably secures the foot ladder connector arm 320 with respect to the second sleeve 120 by engaging one of a plurality of adjustment holes 324 in the foot ladder connector arm 320. The foot ladder connection means allow for easy adjustment of the distance between the ball support 100 and the foot ladder 300 to accommodate people of different heights and/or fitness levels. Other means for connecting the ball support 100 to the foot ladder 300 include hinges, set screws, and/or other fasteners, for example.

In the embodiments shown in FIGS. 1 and 2, the ball base 100 is pivotally connected to the foot ladder 300 through hinge means for ease of storage, with or without disconnecting the foot ladder 300 from the ball support 100. In the embodiments shown, the foot ladder connector arm 320 is pivotally attached to a foot ladder base 301 of foot ladder 300. In FIG. 1, a hinge 322 connects the foot ladder connector arm 320 to the foot ladder base 301.

Figure 7C:
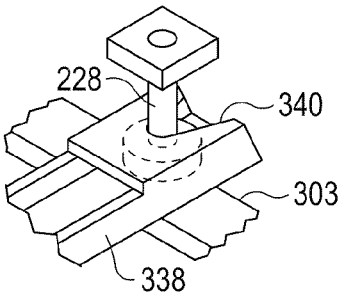
FIG. 7C shows an auxiliary view of a means for retaining a torso support within a foot ladder envelope for storage.
Figure 7D:
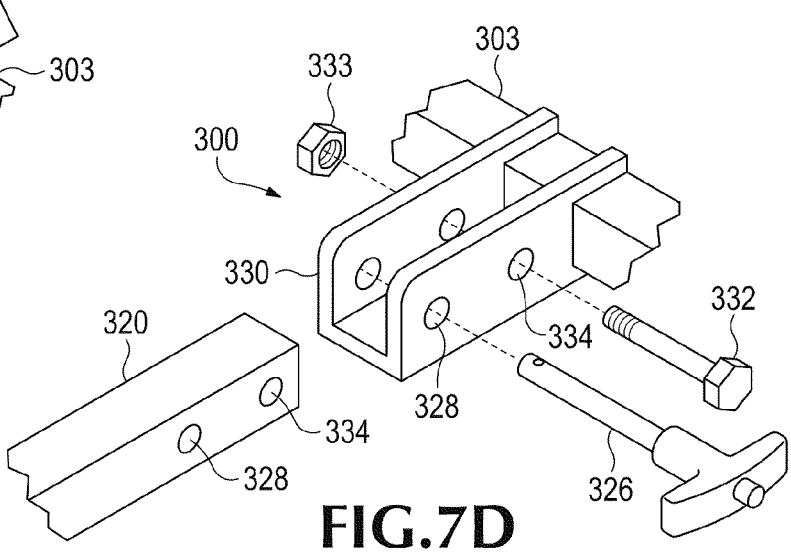
FIG. 7D shows an auxiliary view of a connection between a hinge bracket of a foot ladder and a foot ladder connection arm.
Figure 8:
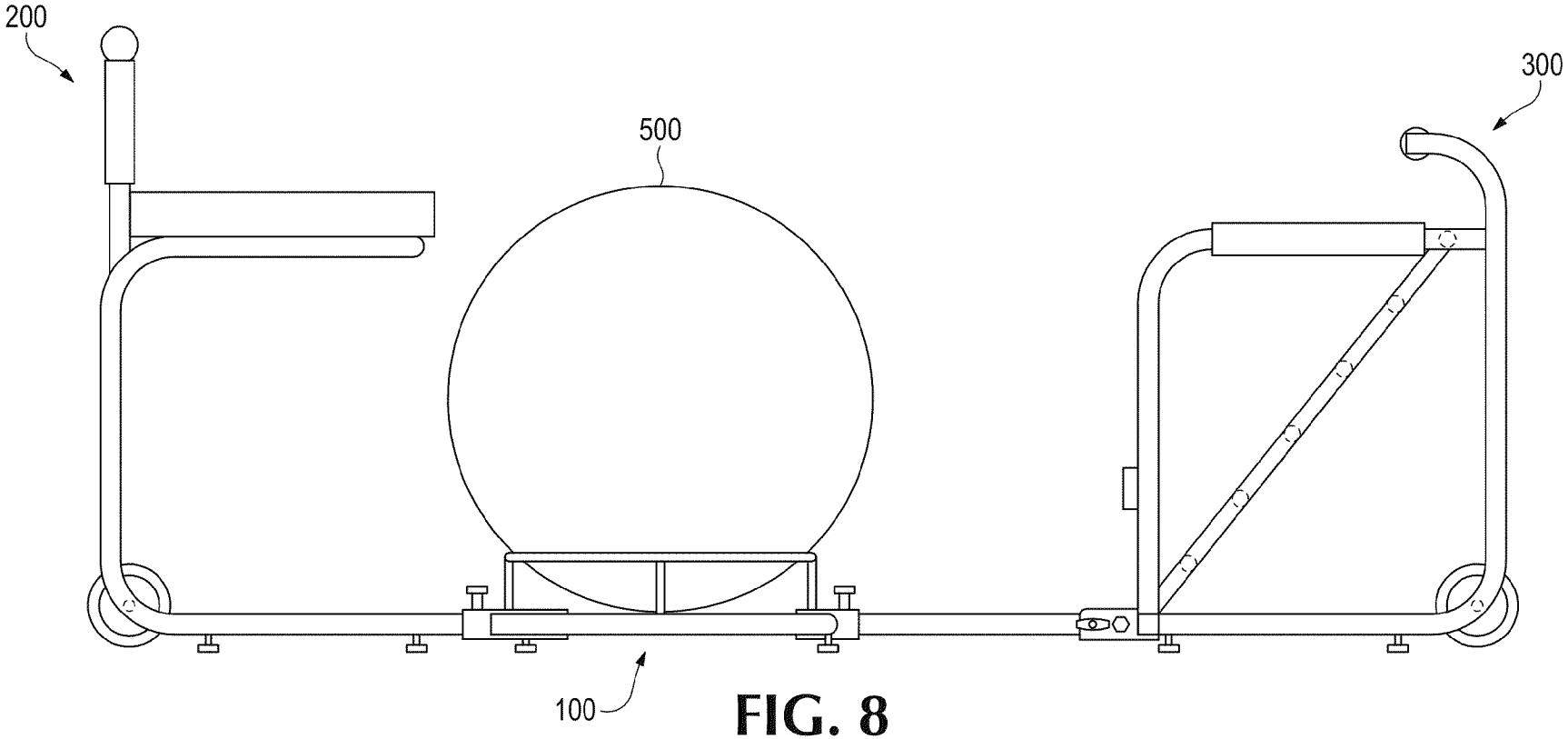
FIG. 8 shows a side view of an embodiment of the exercise apparatus.

FIG. 2 illustrates a robust pivotal means comprising a locking through pin 326 that extends through a first set of cross bores 328 in hinge bracket 330 and the foot ladder connector arm 320 as shown in FIG. 2 and FIG. 7D. The locking through pin 326 is held in place with integral outwardly biased detent balls in the tip of the pin opposite its head portion. The hinge bracket 330 is rigidly connected to the foot ladder base 301. A hinge bolt 332 extends through a second set of cross bores 334 in hinge bracket 330 and the foot ladder connector arm 320, and is secured in place with a hinge bolt nut 333. The second set of cross bores 334 is located adjacent to the first set of cross bores 328 as shown in FIG. 2 and FIG. 7D. To actuate this pivotal means, the locking through pin 326 is removed from the first set of cross bores 328 in hinge bracket 330, and the foot ladder connector arm 320 is pivoted upwardly about hinge bolt 332, as will be discussed later in the context of exercise apparatus 10 storage.

The exemplary foot ladder base 301 comprises a lateral base member 303 and two longitudinal base members 302. Front legs 312 and rear legs 304 are attached to the foot ladder base 302. In the embodiment of FIG. 1, angled handle regions 316 join the front legs 312 with longitudinal top supports 314. In the embodiment of FIG. 2, similar handle regions 316 are shown in a radiused portion located between the front legs 312 and the longitudinal top supports 314. Running from the lateral base member 303 diagonally upward to the top of each rear leg 304 is an angled rung support 308 with rungs 310 attached horizontally between the two angled rung supports 308. The angle between the longitudinal base member 302 of the foot ladder 300 and the angled rung support 308 is preferably between 30 and 50 degrees. The rungs 310 are spaced periodically along the angled rung supports 308 and provide surfaces along which the user's feet (top or bottom of the user's foot) may press during the exercises for resistance. The angled rungs allow the user to progress from easier more upright exercises with bent knees to more difficult exercises in which the legs are extended more horizontally without having to constantly adjust the exercise device. A lateral top support 306 connects the top ends of the rear legs 304 and angled rung supports 308 to provide structural rigidity to the foot ladder 300. A prone heel rest 318 is attached along the top edge of the lateral top support 306 to provide a heel rest during prone exercises. In the embodiment of FIG. 2, the lateral top support 306 is located so as to also provide the function of the prone heel rest 318. The embodiment of FIG. 2 also has foot ladder wheels 336 attached to the junction of the rear legs 304 with the longitudinal base members 302 of the foot ladder 300 with foot ladder wheel axel bolts 344. Furthermore, the embodiment of FIG. 2 has detachable support attachment sleeves 346, whose use will be described later, rigidly fixed along the front side of the front legs 312 of the foot ladder 300. In addition, the embodiment of FIG. 2 also has four foot ladder feet 342 that are attached to the longitudinal base members 302, and two longitudinal nesting foot ramps 338 with ramp notches 340 (see also FIG. 7C). The torso support feet 228 of the torso support 200 slide upon the longitudinal nesting foot ramps 338 and latch under the ramp notches 340 while fixedly nesting the torso support 200 within the envelope or space encompassed by the foot ladder 300 in preparation for storage of the exercise apparatus 10, as will be described in the next section.

In embodiments of the exercise apparatus 10, the outermost lateral widths of the torso support 200, the ball support 100, and the foot ladder 300 are all preferably from 12 inches to 36 inches, and most preferably from 15 inches to 27 inches, wherein the lateral width of the torso support 200 is given by the outermost length and direction of the lateral base member 212 of the torso support 200, the lateral width of the ball support 100 is the outermost length of the ball support base 102 of the ball support 100 in the lateral direction (the direction parallel to that of lateral base member 212 of the torso support 200 in the assembled exercise apparatus 10), and the lateral width of the foot ladder 300 is the outermost length of the lateral base member 303 of the foot ladder 300. See FIGS. 1 and 2.

The exercise apparatus 10 not only provides a framework to support the fitness ball 500 but also provides a biomechanically designed framework for securing (anchoring) elastic members 600, such as elastic tubes 602 and elastic bands 604, as shown in the figures. Other elastic means such as strips, belts, straps, and the like may be used. The elastic members 600 are used in exercises and provide a resistance force along a resistance force direction (in the case of a linear elastic member, or linear elastic member segment, the resistance force direction lies along the current longitudinal direction of the elastic member, wherein the elastic member is configured to pull against its extension by a user).

Figure 9A:
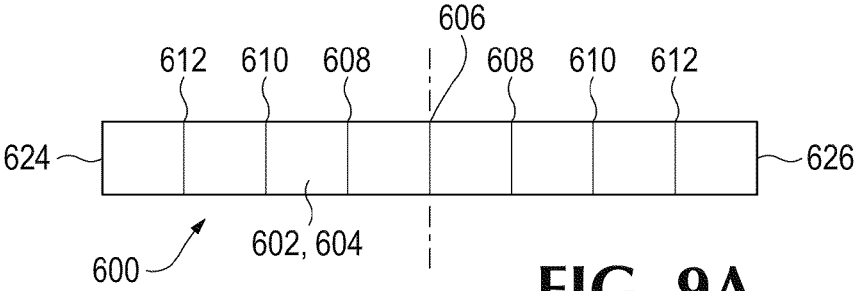
FIG. 9A shows an exemplary elastic member used with an embodiment of the exercise apparatus.

Some embodiments of the exercise apparatus 10 include one or more elastic members 600 (see, for example, FIGS. 13-24). Elastic member 600 comprises a first end 624, a second end 626, a midpoint 606, and first numbered marks 608, as shown in FIG. 9A. The region of the elastic member 600 that is located between the first numbered marks 608 is the midpoint region of the elastic member, and contains the midpoint 606 at its center. In some embodiments the elastic member 600 comprises an elastic tube 602 that is used primarily for leg exercises. The first end 624 is attached to a clip 654, such as a clip 654 that contains a spring loaded closure mechanism, as shown in FIG. 9C, with a knot 656, for example. The clip 654 is in turn clipped on to a D-ring 652. Alternately, the first end 624 may be attached directly to the D-ring 652 with knot 656. The D-ring 652 is connected to an ankle strap 650 through sewing or other attachment means. The ankle strap 650 may comprise a flexible, material such as nylon webbing, that has a hook and loop type fastener system sewed or fastened thereon. Alternately, the ankle strap 650 may comprise a broad strip of a hook and loop fastener type material for removable closure around the user's ankle. The second end 626 of the elastic member 600 is attached to an anchoring point on the exercise device 10 through a knot 656 or clip 654, as described above, or through other connection means. Additionally, the elastic tube 602 may be used for upper body exercises by attaching a handle (not shown) to first end 624.

In some embodiments the elastic member 600 comprises an elastic band 604 that is preferably used for upper body exercises. The elastic band 604 comprises a first end 624, a second end 626, and a midpoint 606 as shown in FIG. 9A. In use, the midpoint 606 of the elastic band 604 is placed over an elastic member attachment point, or anchor point, located on the exercise apparatus 10, and each half of the elastic band 604 is gripped by a user at points approximately equidistant from the midpoint 606 during an exercise. In some exercises, the user may wrap a portion of one half of the elastic band 604 halves around one hand and the other half around the other hand.

In other exercises, both elastic band 604 halves are combined and wrapped around one hand. In still other exercises, two bands are used, wherein both elastic band 604 halves of a first elastic band 604 are combined and a portion is wrapped around one hand, and both elastic band 604 halves of a second elastic band 604 are combined and a portion wrapped around the other hand. To better accomplish this, in some embodiments, the elastic member 600 has a set of paired sequential numbered lateral marks at various distances from the midpoint 606. FIG. 9A shows an exemplary set of three numbered marks—first numbered marks 608, second numbered marks 610, and third numbered marks 612. The set of numbered marks will typically comprise more than the three shown here. The numbers used are sequential in nature and indicate a level of difficulty in extending the elastic member 600 when the band is gripped at that particular numbered marking. For a particular exercise as a user becomes stronger, he or she progresses from using longer member sections, which are easier to elongate by a given distance, to shorter band sections, which are more difficult to elongate by a given distance. In addition, as a user progresses to the midpoint of a given band type, he or she may reach a point where it is desirable to switch to an elastic band 604 of greater resistance or effective elastic modulus to continue his or her strength development.

Some embodiments of the exercise apparatus 10 include sets of elastic members 600, wherein many elastic member 600 resistances may be used. This variable resistance may be achieved, for example in using elastic members 600 whose width or thickness is varied, or in using different elastic member 600 materials, each having a particular effective elastic modulus (the use of the term "effective" refers to the fact that stress strain curves for many elastic materials are nonlinear) or elastic stress strain curve. In some embodiments of the exercise apparatus the force versus deflection characteristics of elastic members 600 are specifically tailored by connecting sections of elastic materials to provide a customized resistance force versus deflection distance characteristics for more enhanced stretching and exercising of particular muscle groups. In some embodiments of the exercise apparatus 10, the sets of elastic members 600 may be color coded for ease of user identification, wherein for example, a user progresses from elastic members 600 having less resistance and colored with a color located at one end of a color spectrum to elastic members 600 having greater resistance and colored with a color at the other end of the color spectrum.

Some embodiments of the exercise device 10 include one or more elastic bands 604, wherein the elastic bands 604 include internal magnetic components that may be removably or fixedly fastened or sewn into the first end 624 and the second end 626, or at other locations along the elastic band 604, on either side of midpoint 606, as shown in FIG. 9A. For example, the magnets could be attached at one set of the paired sets, 608, 610, or 612 of the sequential numbered lateral marks located at various distances on either side of midpoint 606 to provide a user with easy access to end portions of the elastic bands 604 while exercising. For instance if a user is lying supine on the ball 500, as shown in FIG. 13, he or she can attach the end portions of the elastic bands 604 to the handles 204 (which in these embodiments are constructed of ferromagnetic material such as iron or steel) of the torso support 200 for easy retrieval at the start of exercise sets or between exercise sets, rather than having to dismount the ball 500 to retrieve the end portions of the elastic band 604 after having dropped them. The magnets are also useful for elastic band storage. The magnets may also be used to removably fix the elastic band 604 to any other ferromagnetic portion of the exercise apparatus 10, such as the front legs 312 of the foot ladder 300 while completing exercises where the user sits on the ball such as those shown in FIGS. 13-18. Additionally, such magnets may be used with elastic members 600 comprising elastic tubes 602, whereby one or more magnets are inserted into one or more end regions of the elastic tubes 602.

Figure 9B:
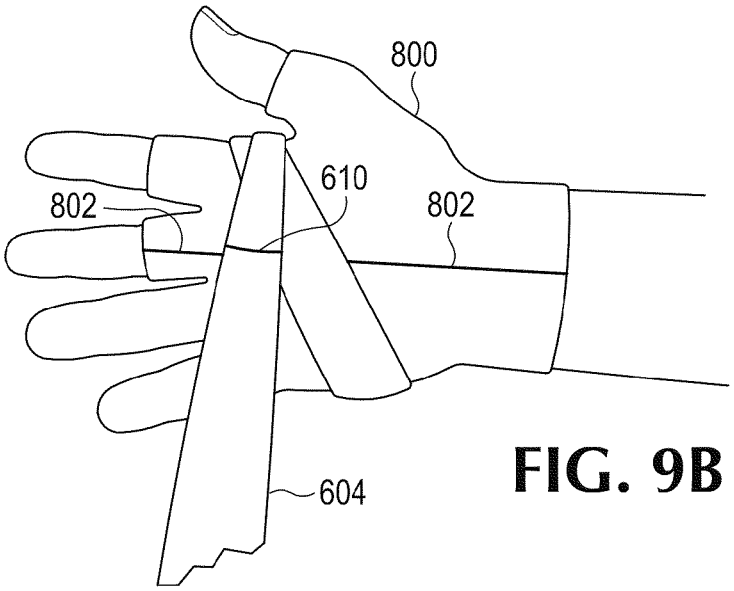
FIG. 9B shows an exemplary glove used with an embodiment of the exercise apparatus.
Figure 9C:
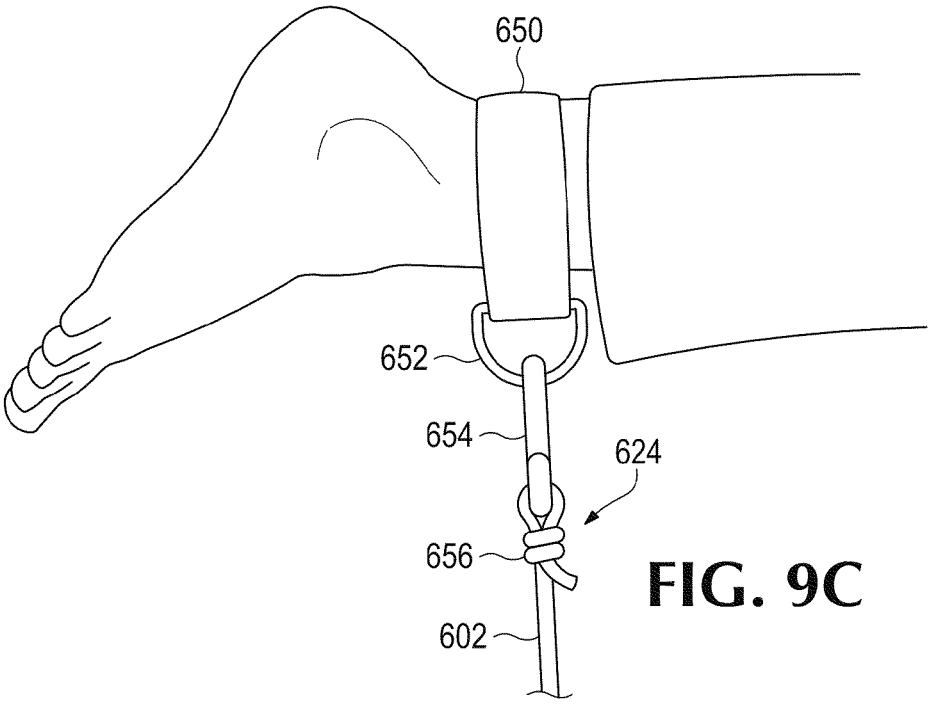
FIG. 9C shows an exemplary ankle strap used with an embodiment of the exercise apparatus.

The elastic members 600 may also be used in combination with gloves 800, as shown in FIG. 9B. In some embodiments of the exercise apparatus 10, the gloves 800 comprise padded gloves having a large friction coefficient, such as that provided by neoprene, and the like. The gloves 800 may optionally have the index and/or middle finger and/or thumb sections partially removed, as shown in FIG. 9B, for ease of handling the elastic members 600. By wrapping the elastic bands 604 around the glove 800, as shown in FIG. 9C, a user's hand does not tire as is the case with free weights or systems using rigid handles, which require a much larger gripping force relative to the force of the resistance provided. Although a user may wrap the elastic bands 604 directly around his or her hand, as shown in FIGS. 13-21, the gloves 800 provide an additional benefit of reduced hand squeeze, especially when constructed of a large friction coefficient material with padding, for example provided by glove materials such as neoprene. In addition, the gloves 800 may have a rigid integral support to help further prevent hand squeeze induced by the wrapped elastic bands 604. Some embodiments of the gloves 800 include an index mark 802, shown in FIG. 9B, that is used for lining up with a selected mark of an elastic band 604, such as the second numbered markings 610, discussed earlier with respect to FIG. 9A, of each half of the elastic band 604. The use of the elastic members 600 will be covered more in a later section.

Figure 3B:
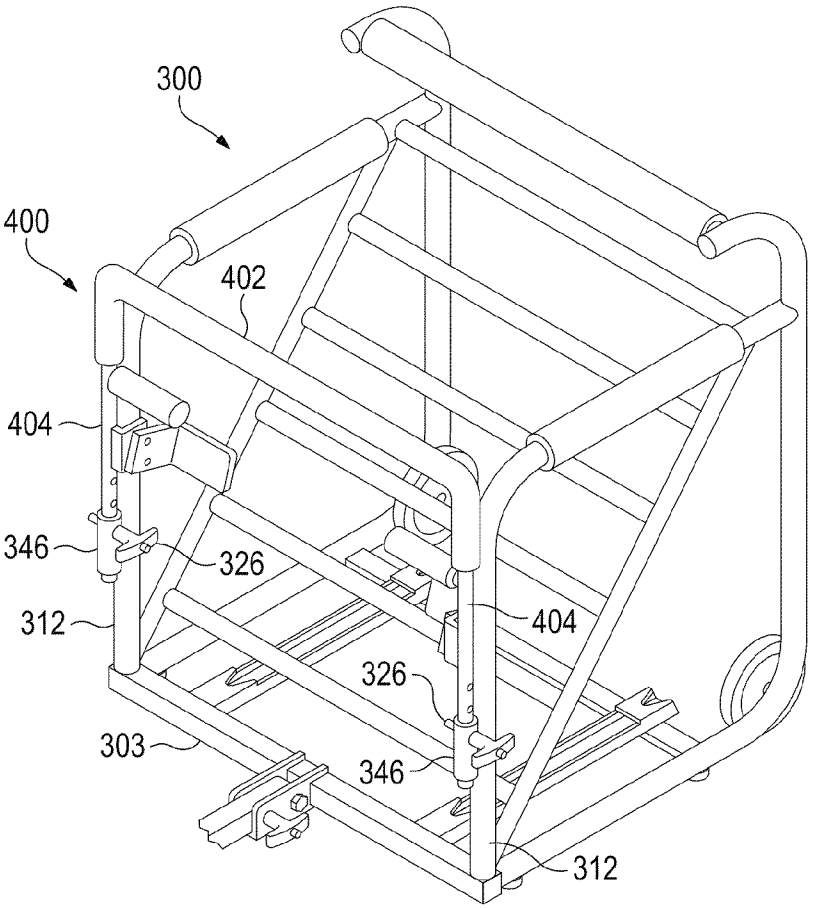
FIG. 3B shows a partial perspective view of an embodiment of the exercise apparatus with a detachable support attached.
Figure 3A:
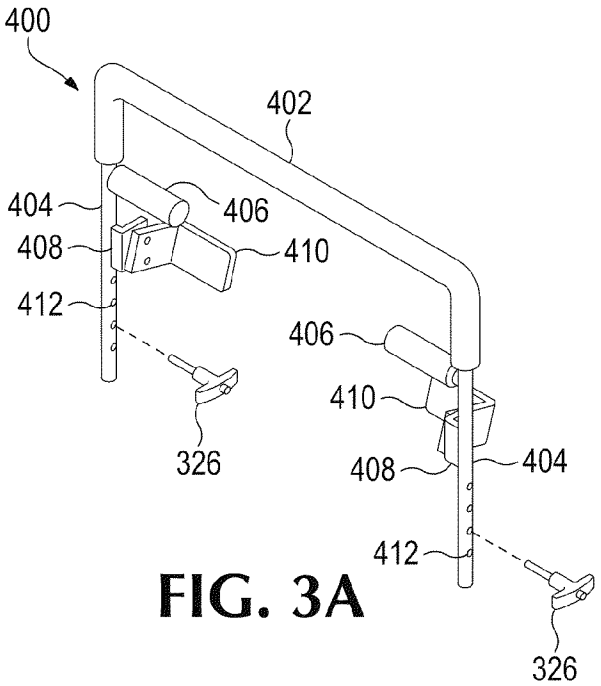
FIG. 3A shows a detachable support for use with the exercise apparatus.

A detachable support 400, shown in FIG. 3A, may also be used with the exercise apparatus for certain stretches and exercises. The detachable support 400 comprises a padded horizontal cross bar 402 with a vertical bar 404 rigidly attached to each end. Shin support bars 406 that are horizontally oriented are rigidly attached to each vertical bar 404. Foot plate brackets 408 are rigidly attached at the lower end of each vertical bar 404. Fastened to each foot plate bracket 408 is a foot plate 410. Each foot plate 410 is adjustable with respect to its corresponding foot plate bracket 408 through the use of fasteners. In the embodiment illustrated in FIG. 4, carriage bolt fasteners extend through rectangular bores in the foot plate bracket 408 and through corresponding cut away slots in the foot plate 410, allowing for the adjustment in the angle of the foot plate 410 to comfortably accommodate a users foot. The lower ends of the vertical bars 404 of the detachable support 400 have detachable support through holes 412 used in adjusting the height of the detachable support 400. The detachable support 400 is attached to the foot ladder 300 by simultaneously sliding the vertical bars 404 vertically down into the detachable support attachment sleeves 346 of the foot ladder 300 so that the foot plates 410 are located toward the angled rung supports 308 as shown in FIG. 3B. Once the desired height of the detachable support 400 is selected, a locking through pin 326 is inserted into the detachable support attachment sleeve through hole 348 and the selected detachable support through hole 412 to lock the detachable support 400 in place.

The horizontal cross bar 402 is used to support a user in various exercises, and the shin support bars 406 in combination with the foot plates 408 are used to fix a users feet and legs in place during certain prone exercises, both of which will be described in greater detail in a later section. It should be noted that the exercise device 10 may also be used as a massage table when the detachable support 400 is attached to the foot ladder 300. In addition, the detachable support 400 is used to hold the foot ladder connector arm 320 and the ball support 100 in place after the foot ladder connector arm 320 and ball support 100 are pivoted upwardly about hinge bolt 332 to nest the assembly within the envelope or volume taken up by the foot ladder 300 for storage (FIG. 6) as described below.

The detachable support attachment sleeves 346 of the foot ladder 300 may also be used to attach one or more pull-down supports in place (not shown). A pull-down support is a long vertical rod having elastic member attachment points 700 located along its length for the attachment of elastic members 600, discussed later. A pair of pull-down supports may optionally have one or more cross bars that provide additional elastic member attachment points 700, and add structural rigidity to a pull-down assembly. The length of the pull-down supports is preferably 4 to 6 feet in length, although other lengths are contemplated. The pull-down supports are configured to provide elastic member resistance directions with vertically downward components to a user that allow for optimal stretching and exercising of muscle groups such as the latissimus dorsi. A pull-down support may optionally have a support framework that attaches to other portions of the foot ladder 300 or the torso support 200. In one embodiment, the pull-down supports attach to sleeves, similar to the detachable support attachment sleeves 346 of the foot ladder 300, that are located on the rear legs 304 of the foot ladder 300, with or without additional support members that provide structural rigidity to the pull-down supports to minimize their deflection while being loaded by a user through elastic members 600 at a downward angle. In another embodiment, the rear legs 304 of the foot ladder 300 extend upwardly to provide the downward resistance function of the above mentioned pull-down supports. In still another embodiment, the pull-down supports attach to or within the handles 204 of the torso support 200 and extend upwardly to provide a framework from which elastic members 600 are attached to provide, for example, pull down resistance to a supine user whose back is resting upon the torso support top 204 of the torso support 200.

Storage of the System

Figure 4:
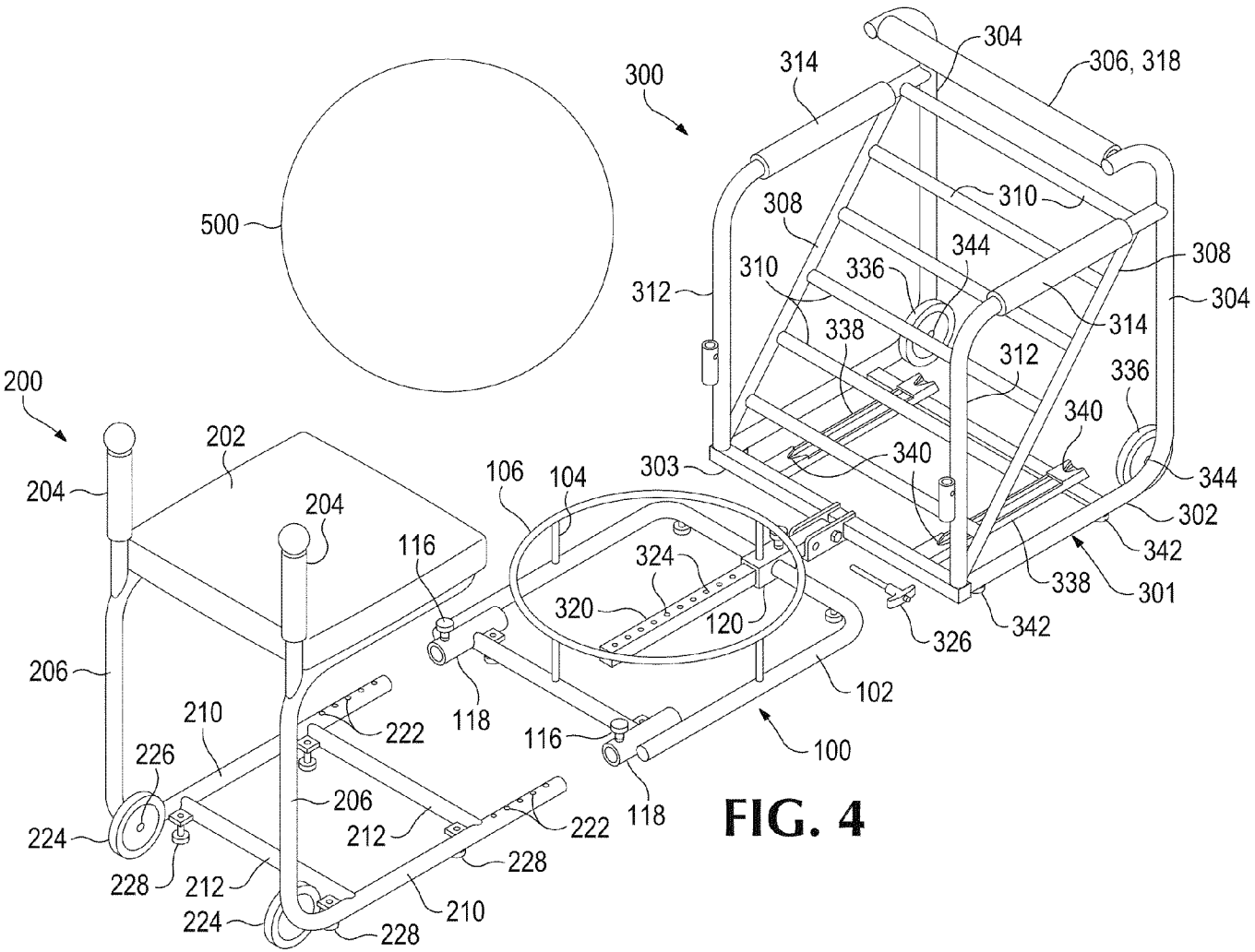
FIG. 4 through 6 show an embodiment of the exercise apparatus in various stages of disassembly for stowing compactly.

The procedure for folding and storing embodiments of the exercise apparatus 10 will now be described with reference to the embodiment shown in FIG. 2. The specific procedure outlined for folding and stowing the unit is exemplary in nature. Other sequences of steps may be used to obtain the same result and are contemplated by the applicant. In preparation for folding, the spring loaded connector pins 116 are retracted from the adjustment holes 222 in the longitudinal base members 210 of the torso support 200 (see FIG. 7A), as described earlier, and the torso support 200 is removed from the ball support 100 by sliding the longitudinal base members 210 out of the first sleeves 118 of the ball support 100, as shown in FIG. 4. Then the locking through pin 326 is removed from the first set of cross bores 328 in hinge bracket 330 and the foot ladder connector arm 320 also shown in FIG. 4 (see also FIG. 7D).

Figure 5:
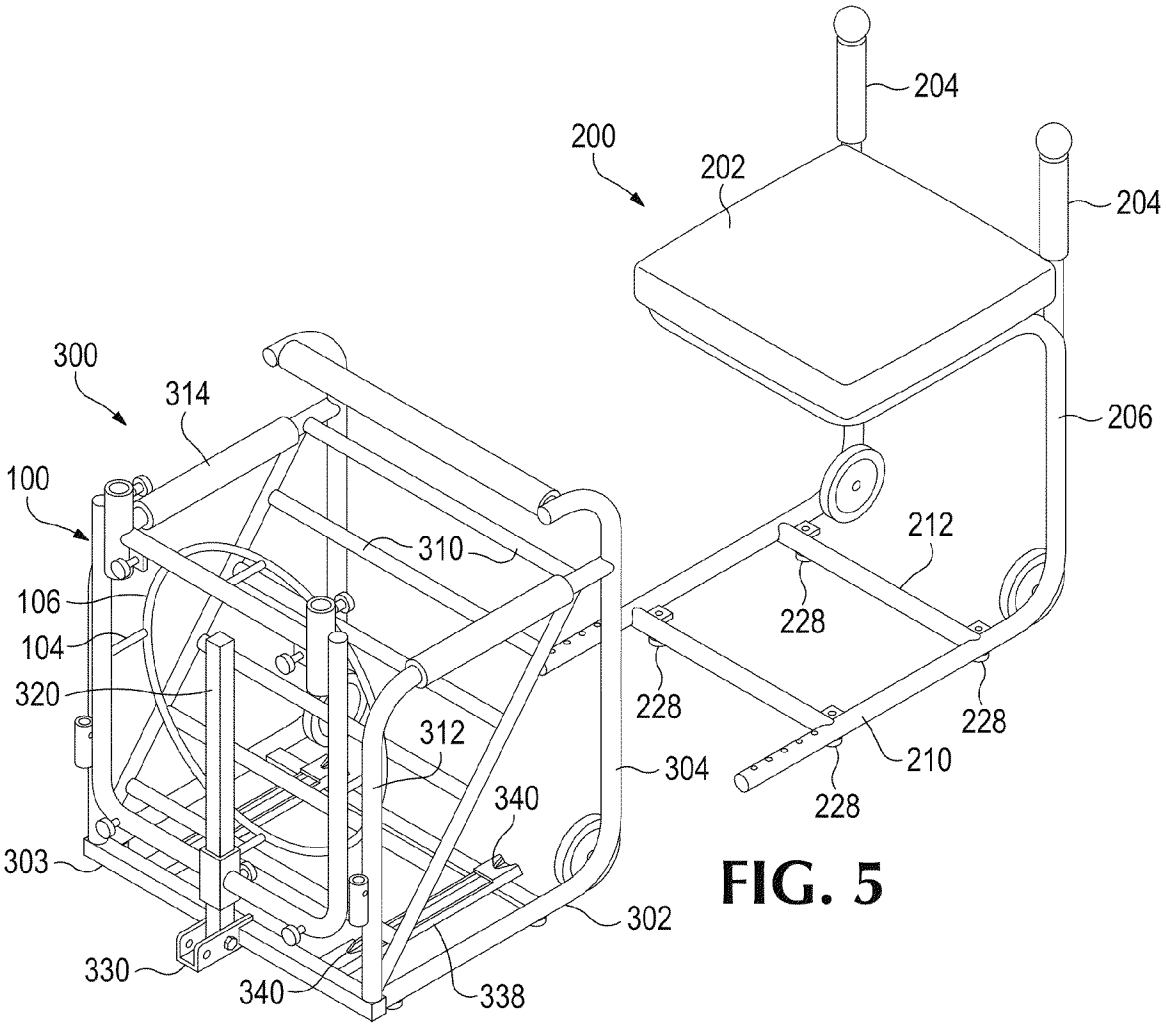
Figure 6:
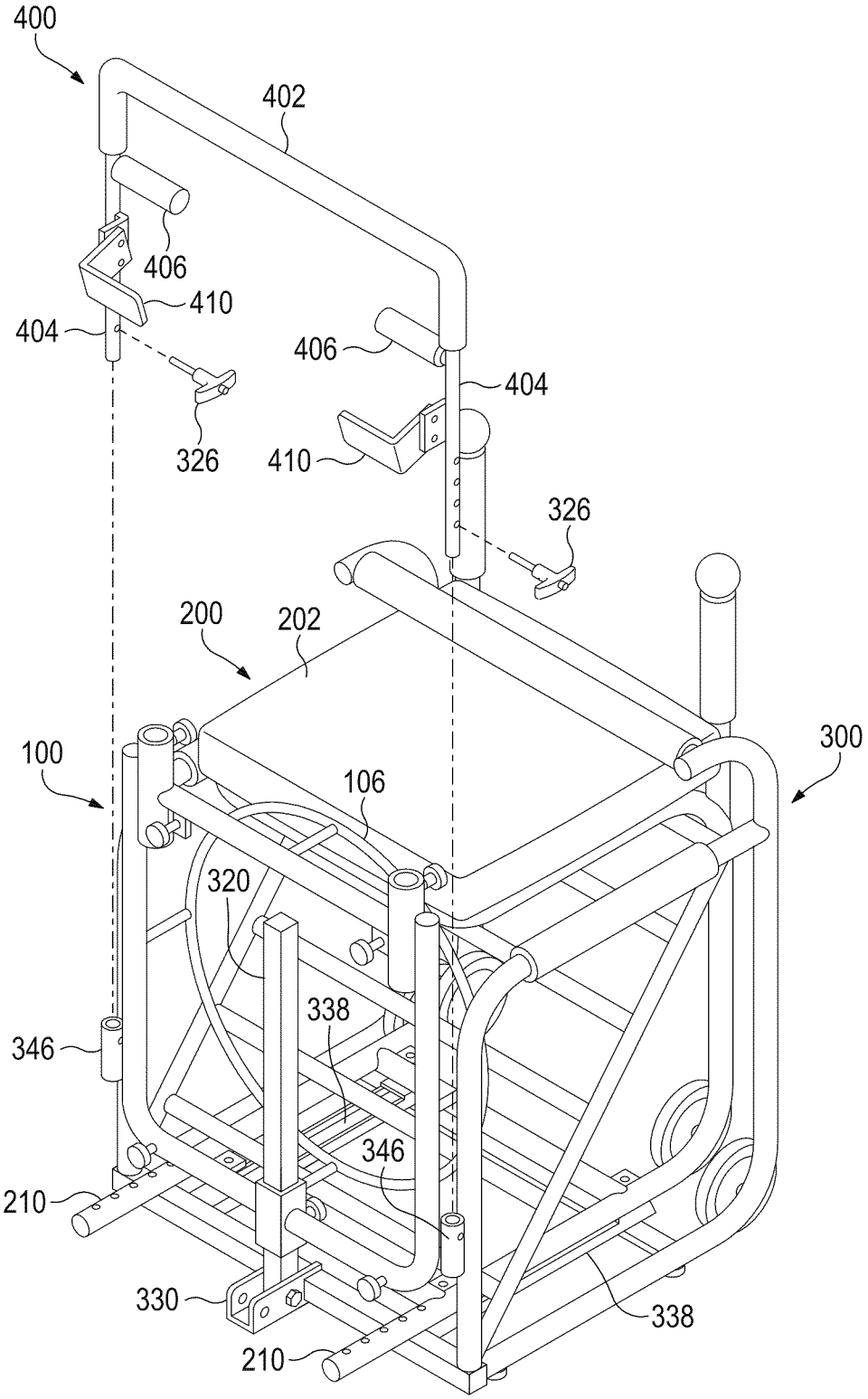

This allows the ball support 100 and foot ladder connector arm 320 to rotate about hinge bolt 332. Then the spring loaded connector pin 116 attached to second sleeve 120, which is attached to the ball support 100, is retracted from adjustment hole 324 in the foot ladder connector arm 320 (see FIG. 7B), and the ball support 100 is slid toward the foot ladder 300 until the second sleeve 120 reaches hinge bracket 330 as shown in FIG. 4. Then the ball support 100 is rotated about hinge bolt 332 so that ball support 100 nests within the volume generally defined by outer members of the foot ladder 300, as shown in FIG. 5. Then the detachable support 400 is attached to the foot ladder to retain the ball support 100 and foot ladder connector arm 320 in place as shown in FIG. 6, where the detachable support 400 is oriented 180 degrees from its exercise use position. Alternately, a clip or other retaining means may be employed to hold the ball support 100 in place in the folded position with respect to the foot ladder 300. Next, the torso support 200 is grasped by the torso support handles 204, tilted rearwardly onto the torso support wheels 224, and moved to the opposite side of the folded ball support 100/foot ladder 300 combination, as shown in FIG. 5. The nesting of the torso support 200 within the foot ladder 300 envelope is accomplished by torso support retention means (see FIG. 7C). The torso support 200 is wheeled into position so that the torso support feet 228 that are furthest from the torso support wheels 224 are located above the longitudinal nesting foot ramps 338, just beyond the location of the nearest set of ramp notches 340, resting these torso support feet 228 upon the longitudinal nesting foot ramps 338, and sliding the torso support 200 into the foot ladder 300 envelope, and lifting the torso support 200 off the torso support wheels 224 so that the set of torso support feet 228 nearest the torso support wheels 224 are lifted onto the longitudinal nesting foot ramps 338 and all of the torso support feet 228 are retained within ramp notches 340 as shown in FIG. 6. The torso support 200 may alternately be held in place with respect to the rest of the assembly by clips or other retention means. The nested unit may then be grasped by the torso support handles 204 tilted rearwardly and easily wheeled into a storage location.

Materials

The exercise apparatus 10 may be constructed with various materials and techniques. In one embodiment, the structural components are constructed from wrought steel or aluminum tubing and/or channel that is fabricated, welded, and machined, as shown, for example in FIG. 1. Another embodiment comprises fabricated steel or aluminum tubing that is bent to shape and/or welded as shown, for example in FIG. 2. Other materials and fabrication processes could also be used, such as constructing components from plastics, composite materials, and the like, using such processes as injection molding, reaction injection molding, and blow molding. Any combination of the above materials and techniques, as well as others, may be used in constructing the exercise apparatus 10, and depend in part upon product sales volume to justify tooling expenditures. Padding such as foam, upholstery, fabric, rubber and the like is used for added comfort on the torso support top 202, the torso support handles 204, the longitudinal top supports 314, the prone heel rest 318, as shown in the exemplary embodiment of FIG. 2, as well as the cross bar 402, the vertical bars 404, and the shin support bars 406 of the detachable support 400, as shown in FIG. 3A. Such padding may also be used for added comfort on other components such as the rungs 310, the front legs 312, analogous components of the exemplary embodiment shown in FIG. 1, the angled handle region 316 of the embodiment shown in FIG. 1, as well as on embodiments not specifically illustrated.

Overview of Exercises Using the Exercise Device

The exercise apparatus 10 has been ergonomically designed and is configured to position a human body at its center. The exercise apparatus 10 offers unprecedented comfort, muscle isolation, and range of motion. By applying kinesiology (the study of human motion) to fitness, whether striving for flexibility, strengthening, or rehabilitation, the exercise apparatus 10 is designed to exercise virtually every muscle in the human body. The exercise apparatus 10 has applications not only for fitness, but also is extremely good for core strengthening and the strengthening of the lower back to help prevent and give therapy to lower back injuries. Using kinesiology terminology, the following descriptions will cite joint motions, and muscles and muscle groups worked. The exercise apparatus 10 of the embodiment shown in FIG. 2 will be used in describing the use of the exercise apparatus 10.

The exercise apparatus 10 is configured to optimize the strengthening of the core muscles of a user's body. In particular, core strengthening refers to the anterior, lateral and posterior spinal stabilization muscles. It is well recognized that the strength and health of these core muscles lays the groundwork for the efficient use of the appendicular muscles (those involved in the joints of the arms and legs). Many of the muscles that are being exercised with the exercise apparatus 10 are two joint muscles. (A two joint muscle has two or more joints lying between the origin end and insertion end of the muscle. Unlike many current devices, the exercise apparatus 10 is configured to fully stretch the origin and insertion of the muscle prior to muscle contraction, thus optimally recruiting and working most muscle fibers. The exercise apparatus 10 is also configured to optimize the stretching and strengthening of muscles used in proximal stabilization during two joint exercises. Proximal stabilization refers to a set of muscles that stabilize a joint that is closer to the spine, for example a shoulder, so that muscles around a more distant joint, for example an elbow, can achieve optimal efficiency.

Exercising on this system may be most productive using free weights or dumbbells of various weights, selectable weight and pulley systems, and/or elastic members having various resistances to motion, depending upon the level of strength and conditioning of the exercising individual. This overview will describe a person going through two exemplary exercise sequences, one using dumbbells and one using elastic members, to give an idea of the breadth of use of the device. Three sets of ten repetitions are generally used in the workouts, though this can vary depending upon user preference. In the first exercise regimen, stretches and exercises are described that include the use of free weights or dumbbells.

Then stretches and exercises are described and illustrated that include the use of elastic means comprising elastic members 600. The use of such elastic means with the device allows a user to optimally exercise and stretch all of the muscles of the body in directions and planes of motion that are not achievable in other devices, as will be shown FIGS. 13-24. It should be noted that a user's customized exercise regimen may include elements from either of the two illustrative exercise regimens, and that a variety of additional exercises and stretches are possible using this extremely versatile device so that the types of exercises done by an individual may be tailored specifically to his or her needs.

Exercise Regimen Using Dumbbells

The description of an exercise regimen using free weights or dumbbells will follow a person through a basic set of exercises using the exercise apparatus by proceeding first through upper body exercises (chest, shoulders, upper back, lower back, arms, abdominals, arms) and then lower body exercises (hips and legs).

In the initial set of exercises, the torso support 200 of the device is removed by disconnecting the torso support 200 from the ball support 100 by first retracting the spring loaded connector pins 116 from the adjustment holes 222 in the longitudinal base members 210 of the torso support 200, as described earlier, and sliding the longitudinal base members 210 out of the first sleeves 118 of the ball support 100, as shown in FIG. 4. In the embodiment illustrated in FIG. 2, the torso support 200 has torso support wheels 224 and is easily transported away from the rest of the device by grabbing the torso support handles 204 while standing on the side of the torso support 200 adjacent the torso support handles 204 and tilting the torso support 200 back on to the torso support wheels 224 (see FIG. 4). Then, if necessary, the user adjusts the distance between the ball support 100 and the foot ladder 300 by shortening or lengthening the effective length of the foot ladder connector arm 320, for example by retracting the spring loaded connector pin 116 attached to second sleeve 120 attached to the ball support 100 and sliding the ball support 100 relative to the foot ladder connector arm 320 so that the device comports to the person's height. The location of the rungs 310 is such that no adjustment of the device is generally needed for a person when transitioning from one exercise to another. This provides the user with a continuity of experience, rather than being inconvenienced by the stop and start of having to make numerous adjustments, and allows the user's muscles to stay warmed up and limber.

Then the user of the exercise apparatus 10 positions him or herself in a supine position on the ball 500 (with his or her back resting on the ball's outer surface) with feet elevated and secure on the foot ladder 300. The individual can work and develop the pectoralis major and pectoralis minor doing a type of bench press exercise using free weights or dumbbells. Horizontal adduction exercises can be done in different planes of motion by using the stable, stationary ball 500 as a resting platform. The foot ladder 300, whose rungs 310 can support the full weight of the user at any point along the rung 310, provides a solid, safe, and secure support to the user. The foot ladder 300 provides the stability to allow the user to do the dumbbell bench presses in various vertical planes relative to the shoulder joint pivot point without the risk of losing one's balance on the ball 500. Furthermore, by positioning the small of the back at different positions on the ball 500 and using a corresponding rung 310 of the foot ladder 300, any angle of incline of the back may comfortably be used.

Next, while seated on the ball 500 with his or her feet secure on one of the bottom rungs 310 of the foot ladder 300, an individual can perform shoulder flexion exercises with the elbow straight to work the anterior deltoid. The next exercise comfortably transitions into overhead presses while still seated on the ball 500. From here, the person can work the lateral deltoid. Still seated on the ball 500 with his or her arms extended straight out to his or her side, the individual will engage in shoulder horizontal abduction while also recruiting upper trapezius muscle fibers.

The next exercise, shoulder shrugs, are designed to fully recruit the upper trapezius, and can be done either seated on the ball 500 or in a standing position in front of the ball 500. After shoulder shrugs, the exercising individual will work the horizontal and inferior fibers of the trapezius, as well as the rhomboids, by affixing the detachable support 400 to the foot ladder 300, as described earlier. The individual positions him or herself in a prone, horizontal position on the ball 500, which rests upon the ball support 100 with his or her feet positioned in the detachable support 400 and the ball 500 positioned generally under the hips with the torso cantilevered out into space. The next exercise in this exemplary exercise routine, bilateral upper extremity horizontal abduction, works the upper posterior shoulder muscles and recruits the spinal extensors for trunk stabilization. The dumbbells are lifted from the ground upward by each arm by bending the arms and lifting the dumbbells generally straight up. Alternately, or additionally flys, where the dumbbells are lifted outwardly to the sides with the elbow joints generally held at an open stationary angle, may be done.

After this, a more purely spinal extension is done starting from the same body position as above, but with the torso starting from a flexed position (reverse sit-ups). This recruits most, if not all, of the primary spinal extensors. The exercise apparatus 10 allows any user, regardless of the degree of his or her fitness and flexibility, to comfortably stretch and exercise these muscles by providing the foot and leg support necessary to torque the upper torso upward, while the exercise ball provides a fulcrum and the foot ladder 300 resists the upward force translated through the legs. A more advanced user will be able to flex his or her upper torso downward around the exercise ball, rather than being constrained to a flat planar surface, as is the case on other devices, and can comfortably flex his or her body upward so that the back is angled backward without suffering the body contact stresses associated with rigid planar devices. This enhances overall flexibility independently of the user's strength. More fit users can user heavier free weights or dumbbells to accordingly get the desired level of workout.

The next exercise is designed to recruit and strengthen the lower trapezius fibers. For this exercise, the individual removes the detachable support 400 and positions him or herself in a supine position on the ball 500 with his or her feet secure on one of the rungs 310 of the foot ladder 300. With both elbows extended, the person initially engages in overhead bilateral shoulder flexion, stretching the lower trapezius fibers as well as the teres major and teres minor. Next, the person contracts these muscle groups performing bilateral shoulder extension. Once again, there is a recruitment of the anterior belly wall muscles (rectus abdominus, interior obliques, exterior obliques, and transverses) as trunk stabilizers during this exercise.

As mentioned earlier, these sequential exercises follow a natural progression. The next exercise further isolates the aforementioned anterior and lateral belly wall muscles. These exercises are commonly referred to as abdominal crunches. These are performed with the individual supine on the ball 500. By positioning him or herself either closer or further from the foot ladder 300, the person can readily isolate and emphasize upper, middle, or lower abdominal fibers without the need to make adjustments to the exercise apparatus. Furthermore, users of various fitness levels are accommodated by allowing the "sit-ups" to be completed from a wide range of starting positions or angles and stopping angles. Again, the extreme rigidity and stability of the foot ladder 300, and the positioning of the rungs 310, enable this full functionality. A more advanced user can flex way back over the back of the ball 500 comfortably and stably without any concern for losing his or her balance, and getting a much greater range of motion and much better abdominal workout than, for example, completing sit-ups while seated on a planar surface such as the floor.

From this same position, the person can next focus on exercising their triceps and biceps. The triceps can be worked with the brachium (upper arm) vertical, allowing the elbow to slowly flex, then extending the elbow into a fully extended position. The biceps can be comfortably worked by allowing the arms to comfortably fall to the side into an extended position. Bicep recruiting is achieved with resisted elbow flexion.

With the completion of the above exercises, most if not all, of the primary muscle groups in the upper body will have been exercised.

The next group of exercises focuses on the lower body. These exercises may be done with ankle weights. The first lower body exercise is hip extension and/or hyperextension. The exercising individual positions him or herself in a prone position with one knee on the ball 500 with arms extended and hands placed on the angled handle regions 316 or the longitudinal top supports 314 of the foot ladder 300. The opposite leg is positioned in knee extension and hip flexion. This stretches out the hip extensors prior to strengthening them. In this position, the individual performs hip extension exercises, working the gluteus maximus and gluteus medius. Hip abduction can also be done from this position, while isolating the gluteus medius. The next exercise is designed to work the hamstrings or knee flexors. For this exercise the person is in the same position on the ball 500. With the hip extensors stabilizing the hip into extension, the person allows the knee to extend, then slowly flexes the knee, working the hamstrings.

The next group of exercises is designed to work the anterior hip and thigh muscles (iliacus, psoas major and quadriceps femoris). For these exercises, the individual reattaches the torso support 200 to the ball support 100, and positions him or herself supine on the ball 500 with his or her upper back comfortably supported on the torso support top 202 of the torso support 200, while holding the torso support handles 204. With one foot placed at the angled handle region 316 or the longitudinal top support 314 of the foot ladder 300, the other hip is allowed to stretch or hyperextend.

This stretches out the iliacus and psoas major muscles prior to exercising them. The person then performs hip flexion exercises. By keeping the knee flexed, the person can isolate the hip flexors. A natural progression from this exercise is to begin to perform knee extensions while maintaining hip flexion. This recruits the quadriceps femoris in a natural functional pattern that mimics walking and/or running.

The last exercise in this exemplary exercise regimen is heel raises. These are done with the person standing, facing the foot ladder 300, with the ball of his or her foot on one of the horizontal rungs 310 of the foot ladder 300. This stretches out the gastrocsoleus group prior to performing plantar flexion exercises.

Exercises Using Elastic Members

Although free weights or dumbbells can be used with the exercise apparatus 10, they are limited as the resistance force they generate has only a vertical component, that of the earth's gravitational field acting upon the weight in a downward fashion toward the ground. Using the arms and legs as levers, this system emphasizes complete range of motion while protecting the joints from injury. The elastic members 600 also control for and minimize velocity, which is induced by the momentum of conventional weights and can lead to injury. By using elastic members 600, embodiments of the exercise apparatus 10 may be used to optimally exercise nearly all of the prime movers of the human muscular system by strengthening each throughout its the full range of motion. Furthermore, the use of elastic members 600 utilizes the user's time efficiently by eliminating the need to change positions between sets to place a free weight on the floor to momentarily rest. With elastic members 600, resting between sets is as simple as creating slack in the members. Creating slack does not require letting go of the elastic members 600 nor does it generally require getting out of the exercising position.

The elastic bands 604 and elastic tubes 602 can attach to virtually any part of the exercise apparatus 10, making the types of exercises almost limitless. The elastic members 600 can be easily moved from one location to another as well as upgrading or downgrading the level of resistance by using elastic members 600 of greater or lesser resistances. The exercise apparatus is ideal for the rehabilitation of injuries, such as shoulders, backs, and knees. The exercise apparatus 10 is quite effective in executing back rehabilitation protocols, such as the McKenzie extension program and the Williams flexion program.

Exercise Regimen Using Elastic Members

Figure 10A:
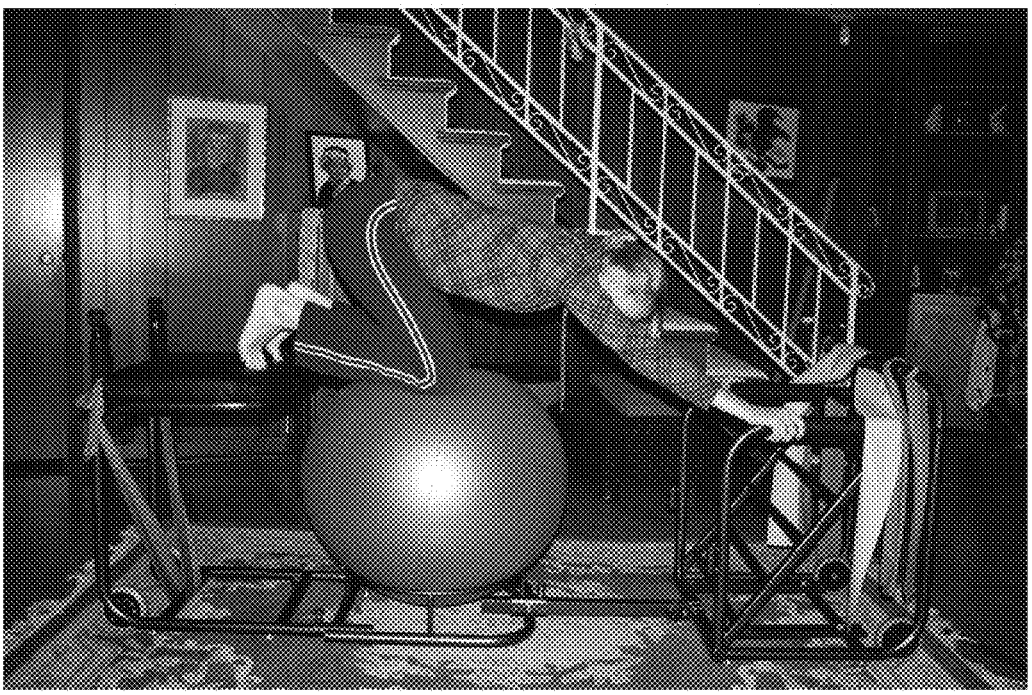
FIGS. 10-24 illustrate numerous exemplary stretches and exercises that may be done utilizing embodiments of the exercise apparatus.
Figure 10B:
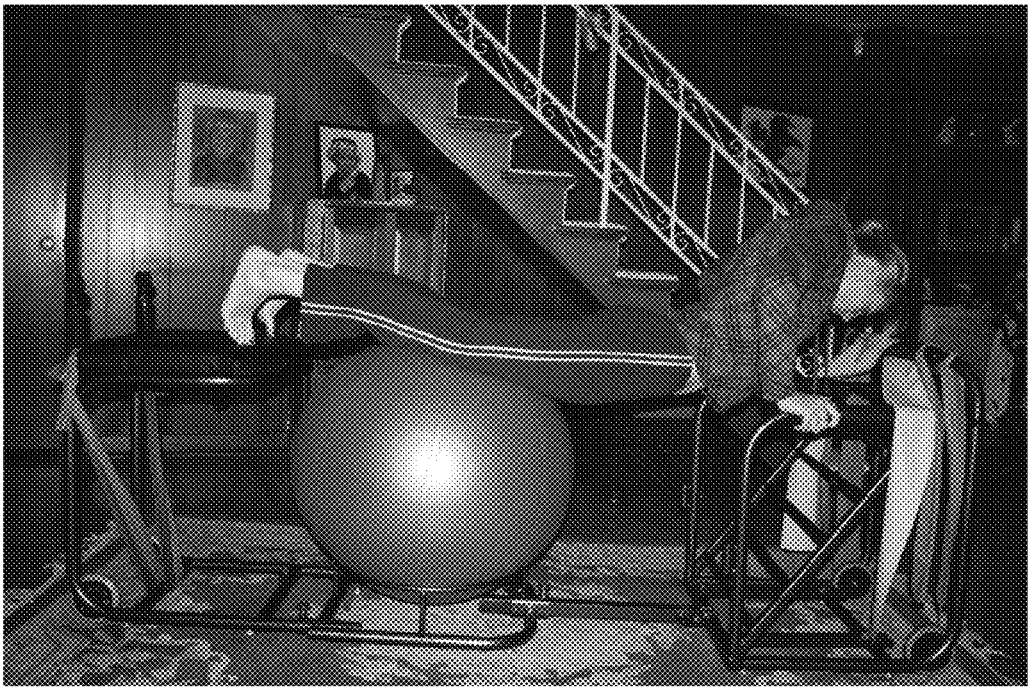

FIGS. 10A and 10B show one of the numerous flexibility exercises that can be performed on this system. It is well recognized that lack of flexibility of the back structures and the hamstrings can put an individual at increased risk of low back pain, back injuries, and even intervertebral disc injuries. The exercise shown in FIGS. 10A and 10B stretches out anterior and posterior vertebral and hip structures coupled with stretching shoulder structures. The knees are comfortably positioned on the ball 500 with the hands supported by the padded longitudinal top supports 314 of foot ladder 300.

Figure 11A:
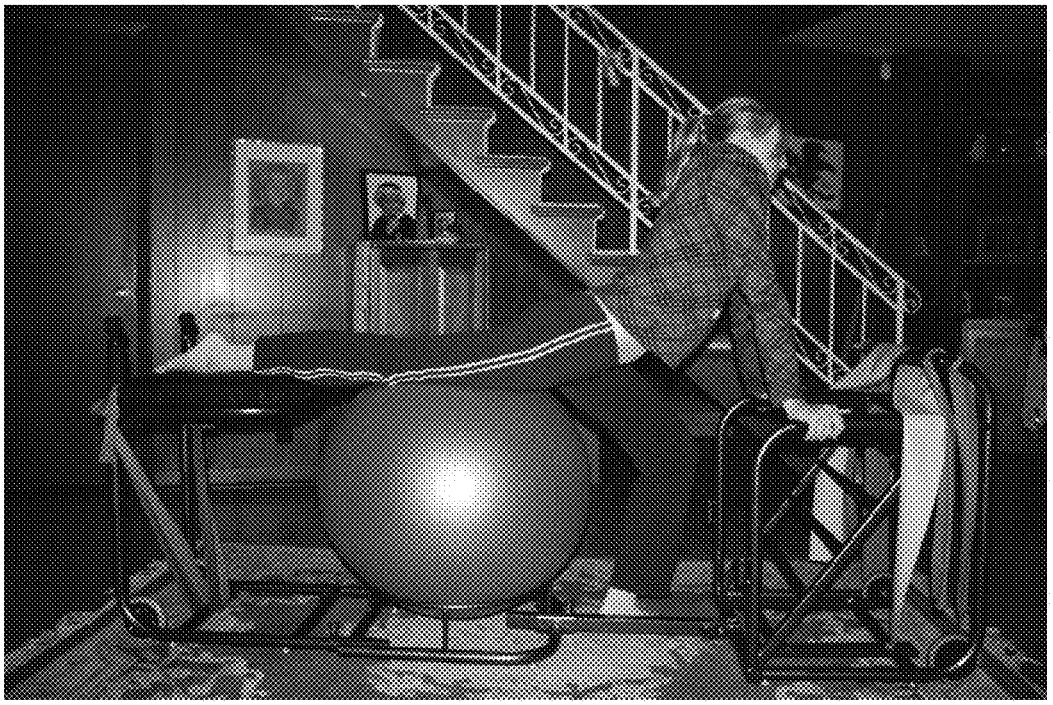
Figure 11B:
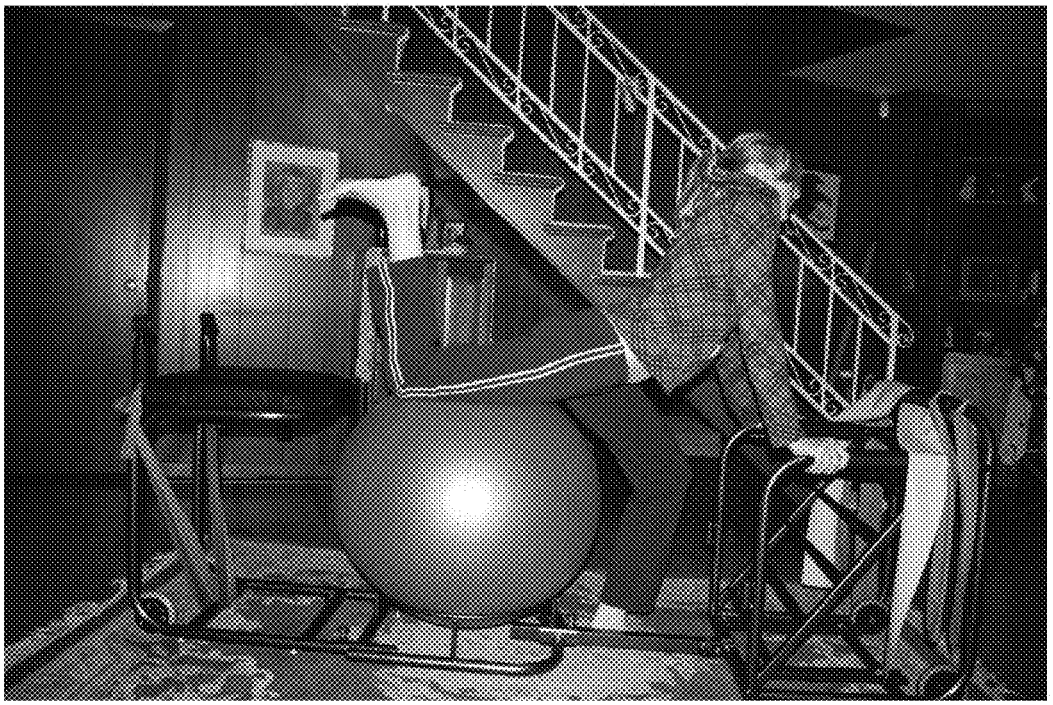

FIGS. 11A and 11B show a modified stretch of the hip flexors and quadriceps while enhancing vertebral extension. As can be seen, these are done from a very optimal biomechanical position where the thigh is comfortably positioned on the ball 500, and the hands are supported by the padded longitudinal top supports 314 of foot ladder 300. One of the many advantages of engaging in stretches on this system is the ease of preparing for the stretching exercises, and the multitude of poses enabled. Analogous conventional stretches, if they exist, often require unstable positions or are performed with the individual on the floor. For example, hamstring stretches are conventionally performed sitting on the floor with legs extended. Using the exercise apparatus 10, a user having a lesser degree of flexibility can sit on the ball and place his or her feet on the lower rungs 312 of the foot ladder 300, and begin a flexibility regimen. As one's flexibility improves the individual can advance their foot placement to rungs 312 that are located further up the foot ladder 300, thereby increasing the hamstring elongation forces induced as the person leans his or her trunk forward. As is amply illustrated by the Figures, the exercise apparatus 10 provides a safe, stable, and convenient environment for the stretching, strengthening, and rehabilitation of those who use it.

Figure 12A:
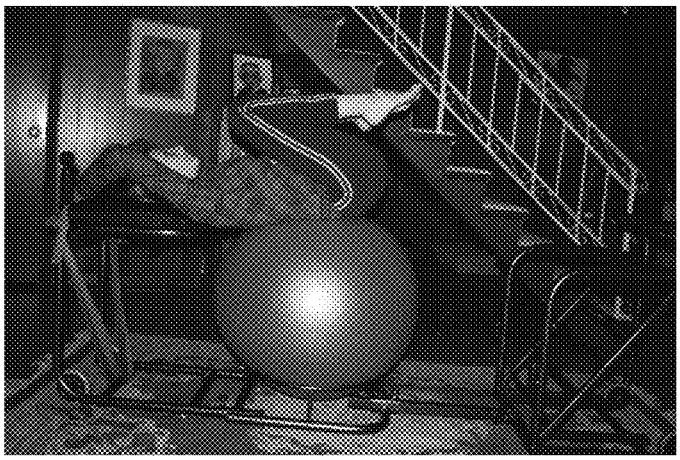
Figure 12B:
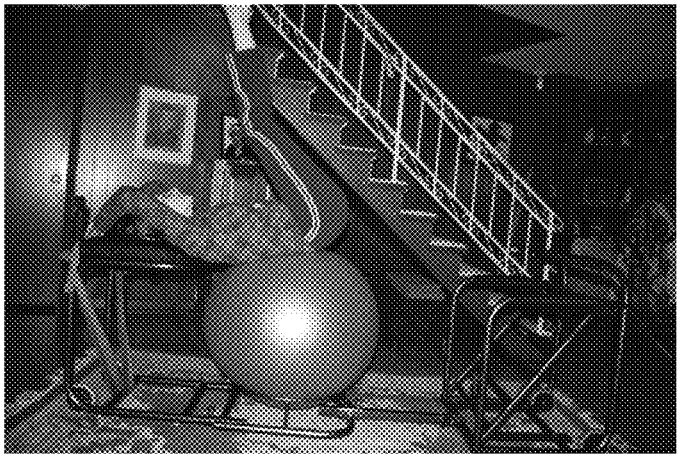
Figure 12C:
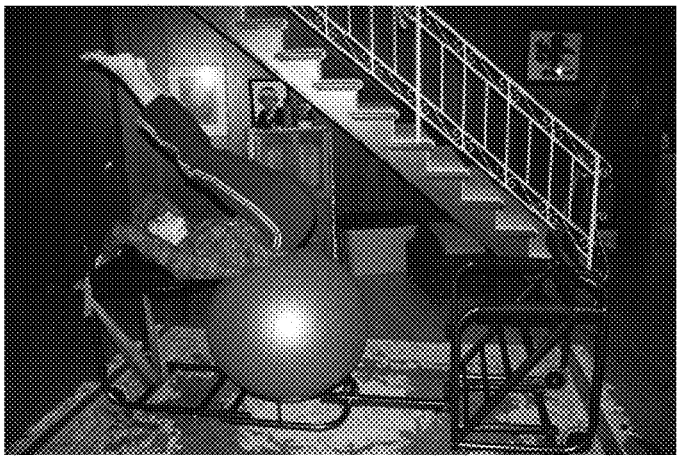

FIGS. 12A, 12B, and 12C show a progression of stretches that are more advanced than the hamstring stretching exercise discussed above. In this exercise the individual begins in a supine position on the ball 500. While extending knees and bringing the legs overhead, progressive vertebral flexion is achieved, in addition to hamstring stretching. In addition to enhancing flexibility, this particular exercise also recruits muscles engaged in and responsible for core strength and stabilization. The robust torso support 200 and two vertical handles 204 are crucial for safety and ergonomics when performing this exercise.

After having completed the above initial stretches, exercises will now be described and illustrated that use the exercise apparatus 10 in combination with elastic members 600.

Figure 13A:
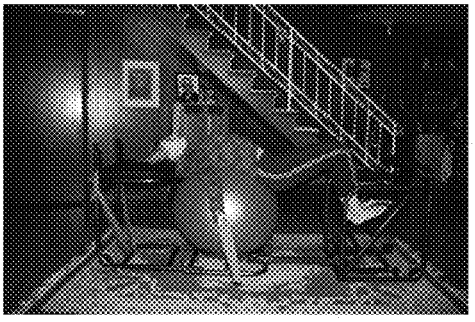

FIG. 13A shows a person supine on the ball with the spine fully supported in a state of extension. To appreciate the muscles worked in this exercise one can envision the standard bench press which uses a barbell. Instead of an individual risking possible strangulation or cervical injury, as can occur when an individual is unable to return the heavy barbell to its starting position with the arms extended upward, an exercising individual can comfortably exercise the same muscles to the same extend without risking such injury, even if when exercising alone.

Figure 13B:
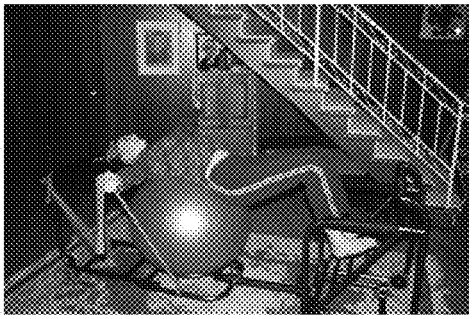
Figure 13C:
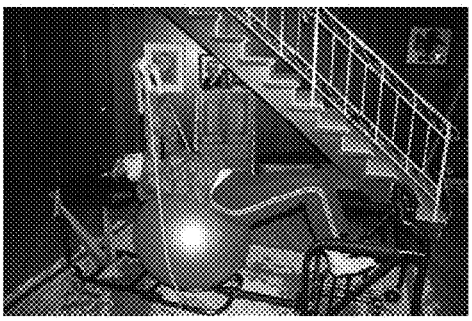
Figure 13D:
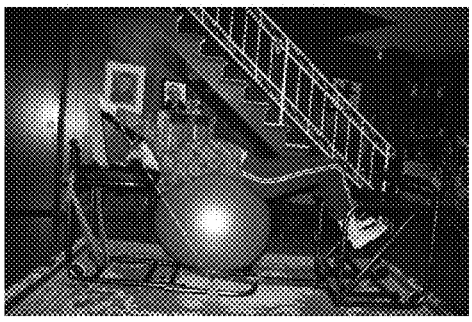

In the particular exercise shown, the elastic members 600 are attached to the ball support base 102, the user is able to perform a motion called horizontal adduction, which isolates the pectoralis major and pectoralis minor. FIGS. 13B and 13C show the range of motion as the person works the pectoralis major through horizontal adduction. (Note that the term "horizontal adduction" may seem misleading since in this exercise the motion is vertical. Anatomical terminology references the human body with respect to a standing anatomical position where the arms are held at the side with the palms facing forward.) The ball base 100, the ball 500 and the foot ladder 300 provide the required level of stability to perform this and many other exercises safely. In this exercise, the individual can select from among the numerous locations of the rungs 310 of the foot ladder 300 throughout the exercise sets by either ascending or descending the foot ladder 300 with his or her feet. The rungs 310 are configured to be spaced apart so that a user's heel may be placed on one rung 310 while his or her toes can push up against the next higher rung 310 to provide stability for this and many other exercises. The plane of motion of the exercise of FIGS. 13A, 13B, and 13C is shown by looking at the progression of the user's arms through the three figures. In FIG. 13D, the person is performing a similar exercise, but at in a plane of motion that more optimally develops and strengthens the upper fibers of the pectoralis major. A common exercise designed to work these same fibers requires an incline bench and a barbell or dumbbells.

Figure 14A:
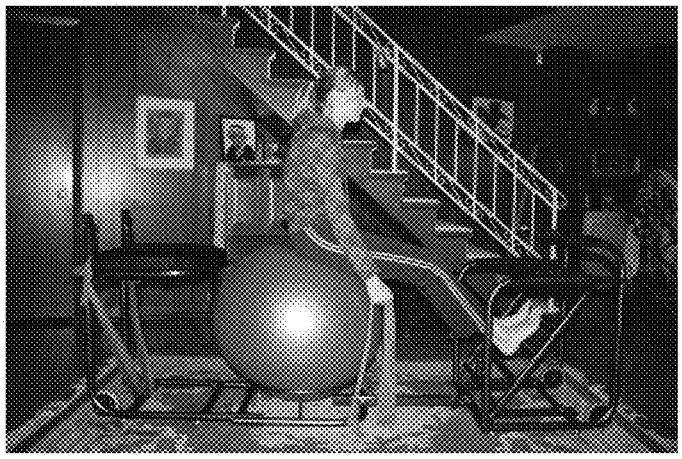
Figure 14B:
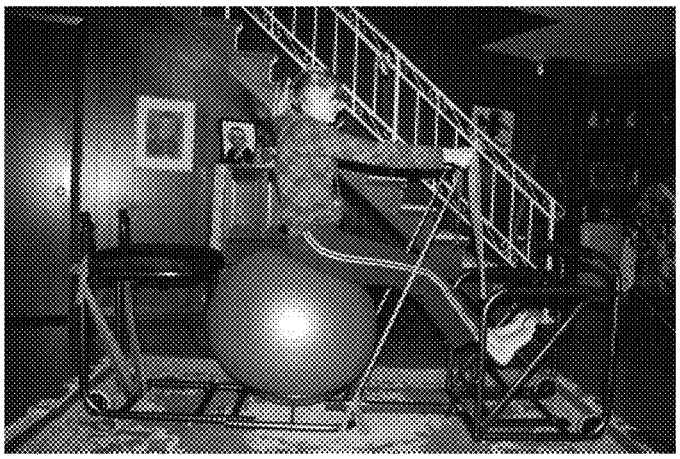
Figure 14C:
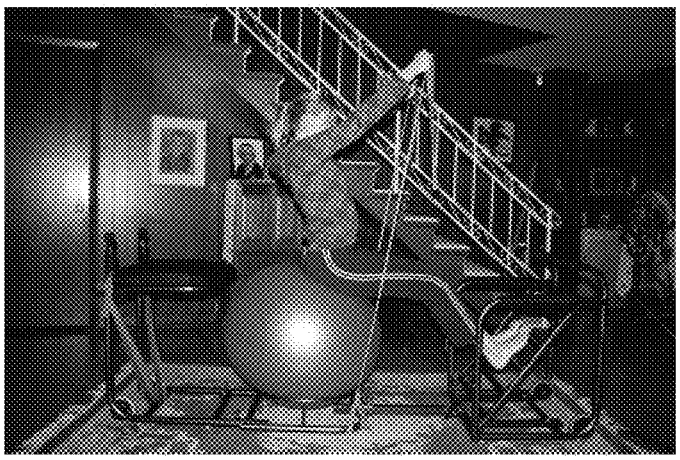

FIGS. 14A, 14B, and 14C show a person seated on the ball 500, working the anterior deltoid through a motion called shoulder flexion. FIG. 14A shows the previously mentioned slack in the elastic members at the beginning the exercise. Note the importance of core stability during this exercise as the spine progressively transitions into extension and even hyperextension with increased shoulder flexion. By extending the arms outwardly, the resistance force provided by the elastic bands 604 to the spinal stabilizers is amplified through a lever arm principle.

Figure 15A:
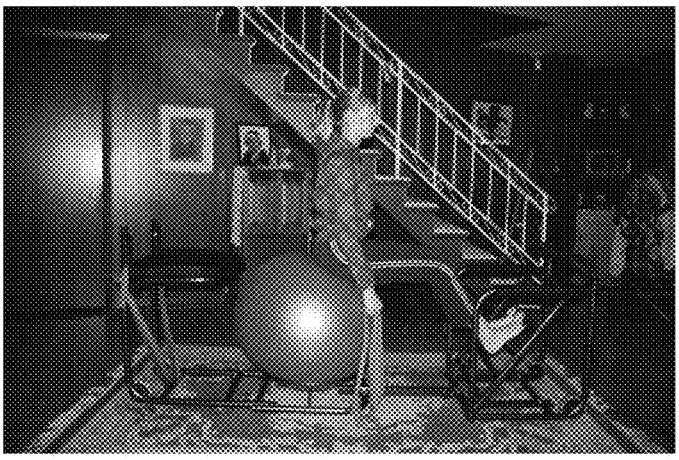
Figure 15B:
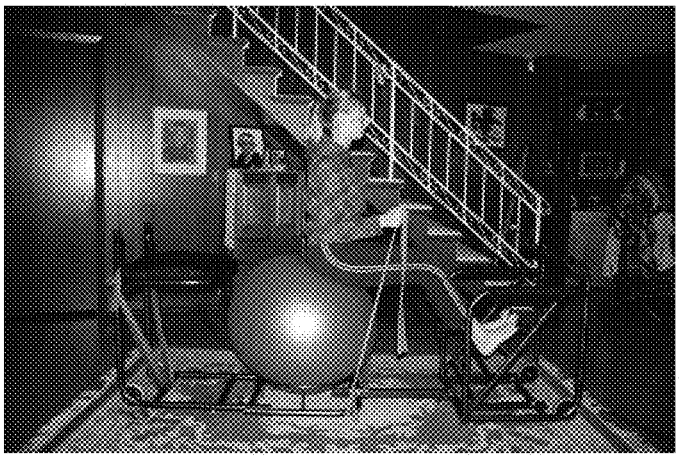
Figure 15C:
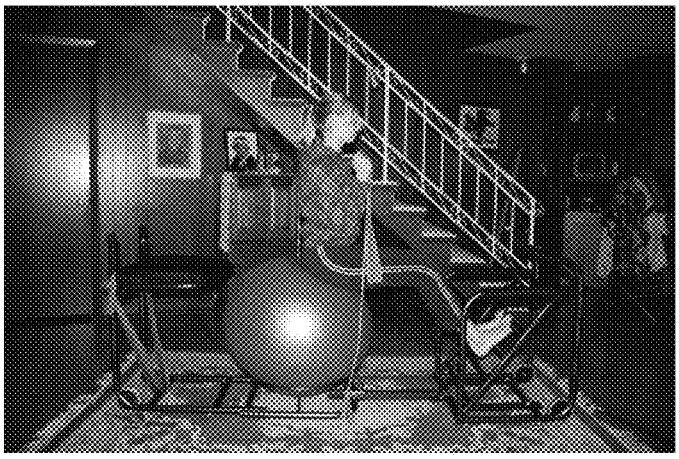

FIGS. 15A, 15B, and 15C show elbow flexion commonly termed "curls" by working the biceps brachii and brachialis. Transitioning from one exercise to the next with this system often requires minimal change of position. Note the same position of the individual both on the ball 500, as well as the foot placement on the foot ladder 300 as the previous exercise of FIGS. 14A, 14B, and 14C.

Figure 16A:
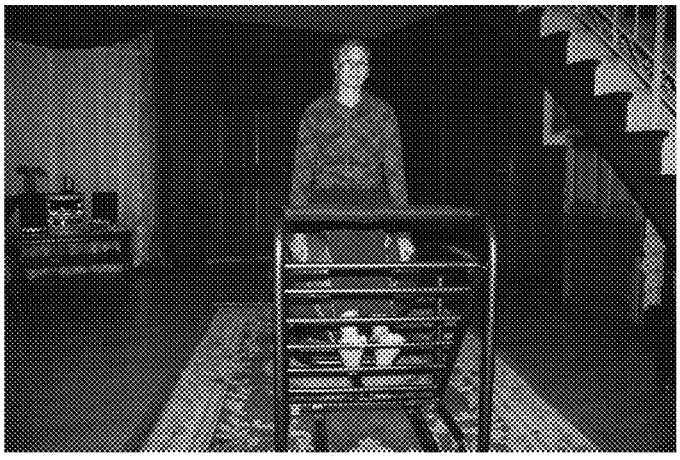
Figure 16B:
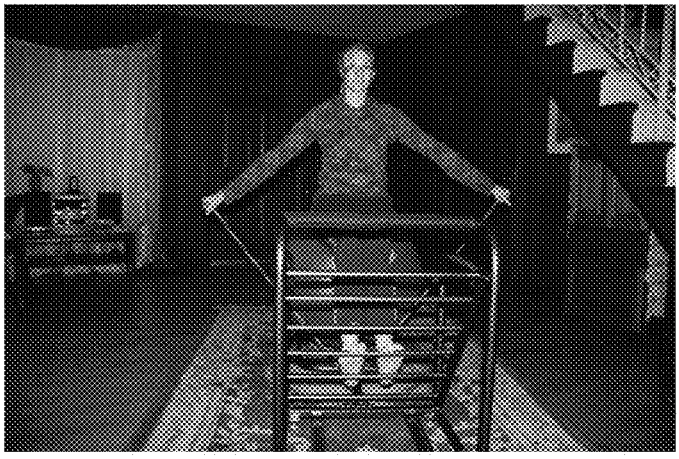
Figure 16C:
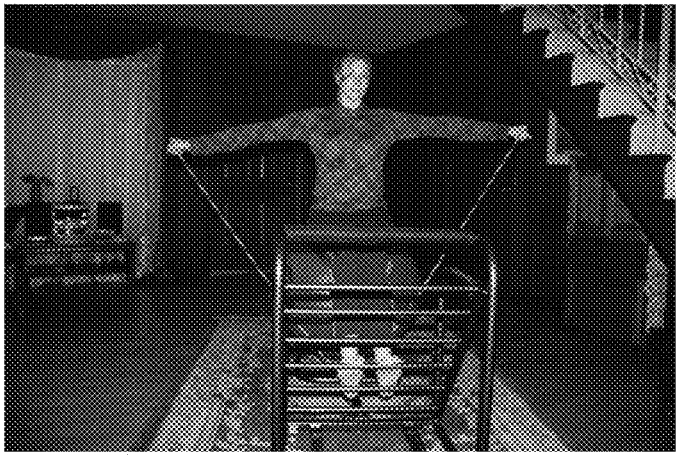

FIGS. 16A, 16B, and 16C show shoulder abduction, which works the middle deltoid and supraspinatus and enhances core stabilization while seated on the ball 500. In this exercise, one elastic band 604 may be used, where the midpoint 606 of the elastic band 604 is positioned around the midpoint of one of the lower rungs 310 of the foot ladder 300, and one of the elastic band 604 halves is wrapped around one hand and the other elastic band 604 half is wrapped around the other hand. Again, note the slack in the elastic band 604 to begin the exercise, same body position as the previous two exercises, and application of the lever arm principle for maximal muscle fiber recruitment.

Figure 17A:
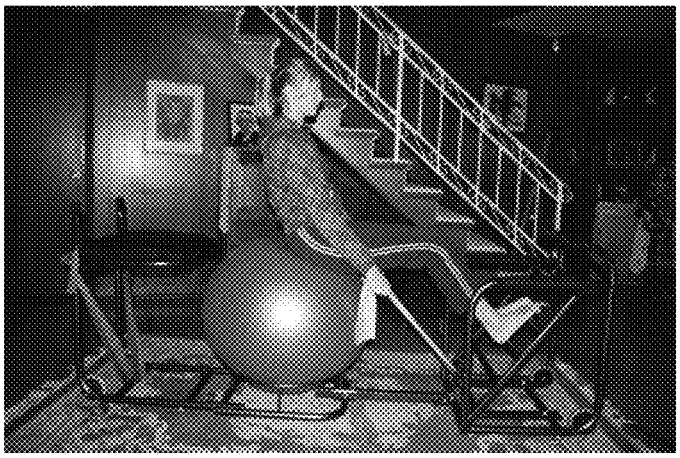
Figure 17B:
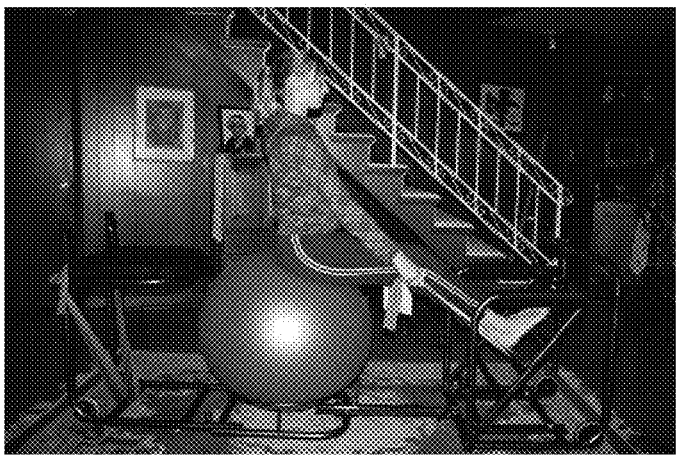
Figure 17C:
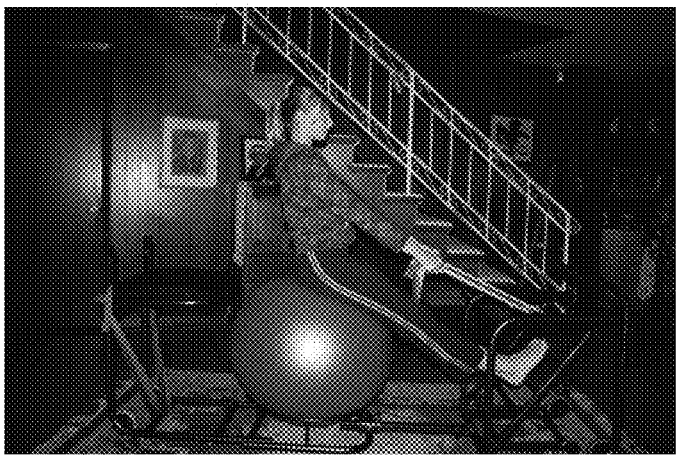

FIGS. 17A, 17B, and 17C show the individual again in the same position as the previous three exercises. Conventionally, shoulder shrugs are performed either with a barbell or dumbbells, where the individual grips the barbell/dumbbell while elevating his or her scapula by recruiting the trapezius muscle. Here, the user is seated on the ball 500 with feet secure on a rung 310 of the foot ladder 300. In FIG. 17A, the elastic band 604 is anchored to the midpoint of the rung 310 that is lowest on the foot ladder 300, by wrapping the midpoint 606 of the elastic band 604 over the midpoint of the rung 310 that is lowest on the foot ladder 300. With the feet secured by one or more rungs 310 of the foot ladder 300 that are located above the lowest rung 310, the person shrugs his or her shoulders by elevating the scapula. As can be seen in FIG. 17A this may require a posterior lean of the trunk. Anchoring the elastic band 604 to the rung 310 that is lowest on the foot ladder 300 recruits the upper trapezius fibers. As the person anchors the elastic band 604 to a higher rung of the ladder, lower trapezius fibers are recruited or exercised. The kinesiology of this exercise is described as scapulo thoracic motion. This describes that joint motion is occurring between the scapula and the thoracic cage. As the elastic band 604 is anchored to the rungs 310 that are located toward the top of the foot ladder 300, scapular retraction and protraction occur, which recruit the rhomboids in addition to the trapezius. Again core stabilization is foundational for effective strengthening of the trapezius and rhomboid muscles.

Figure 18A:
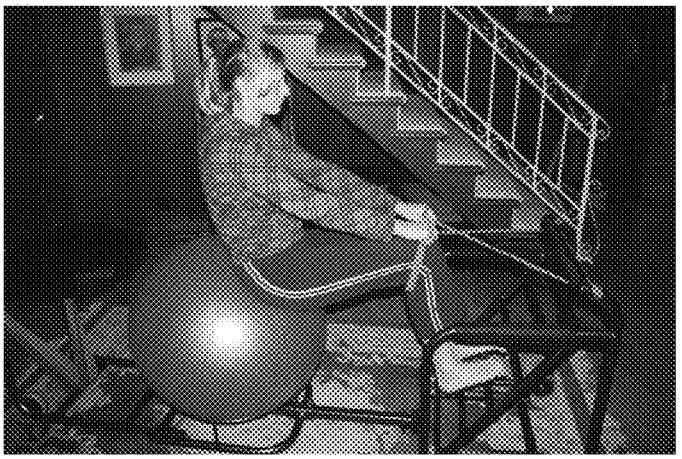
Figure 18B:
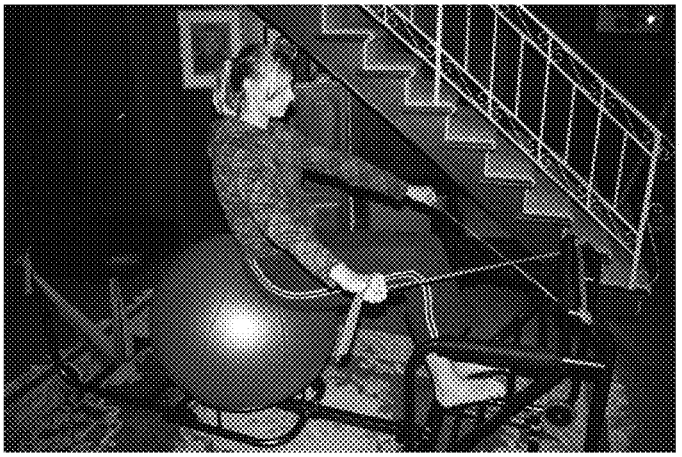
Figure 18C:
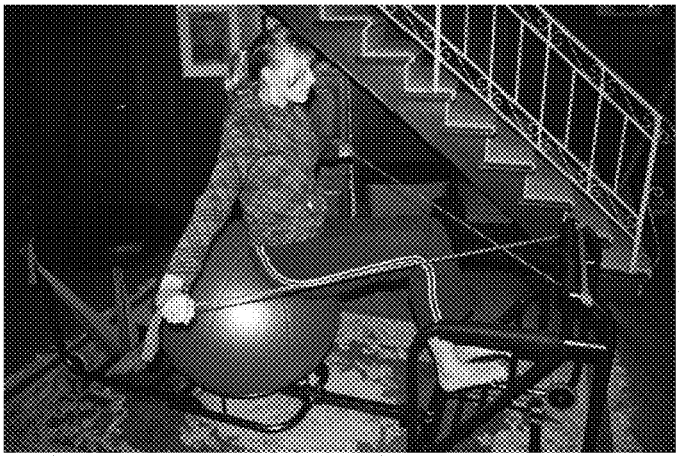

FIGS. 18A, 18B, and 18C show motion occurring between the humerus and scapula (glenohumeral motion). Muscles involved entail posterior deltoid, infraspinatus and teres major and minor. Again appreciate the core stabilization during these exercises. Alternately, this exercise may be done by exercising one shoulder at a time. Here, the elastic members 600 are attached to the junctions of the rear legs 304 with the lateral top support 306 of the foot ladder 300. Note that each elastic member 600 is anchored on a side of the foot ladder 300 that is opposite to the side from which the user grips that elastic member 600. This creates resistive forces which cross midline. By anchoring the elastic member 600 on the contralateral side of the foot ladder 300, the effectiveness of this exercise is enhanced since the resistive forces induced by the elastic member 600 is from a direction that better recruits the various core muscles.

Figure 19A:
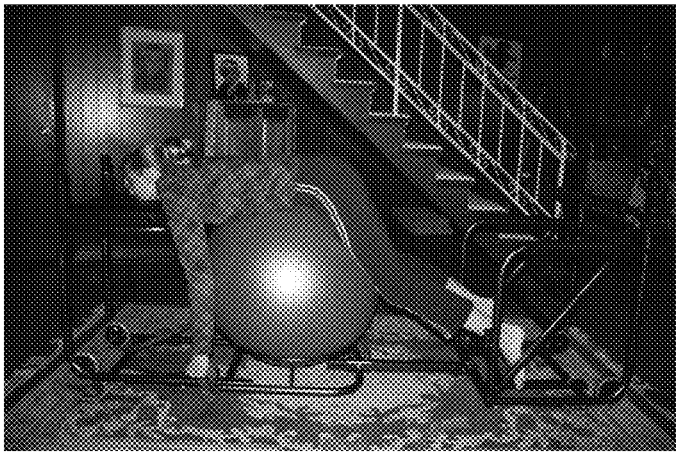
Figure 19B:
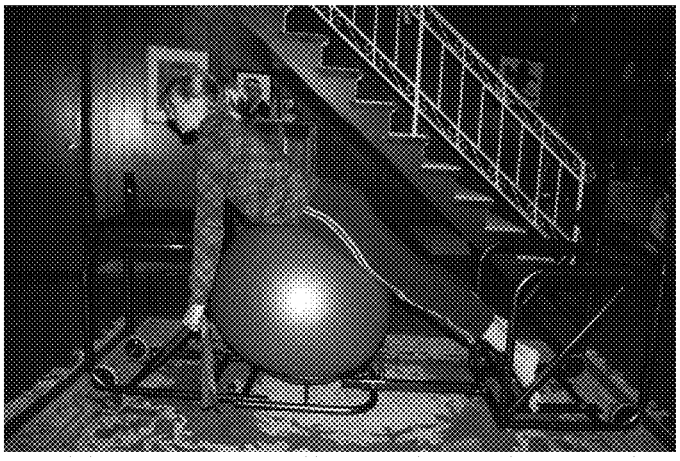
Figure 19C:
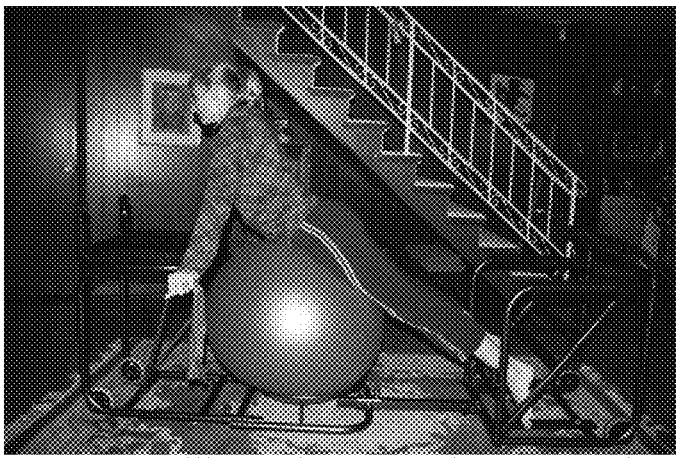

FIGS. 19A, 19B, and 19C show exercising the posterior spinal extensors with the subject prone on the ball 500 with feet stabilized on the foot ladder 300. It is well recognized that when strengthening the anterior, lateral and/or posterior spinal musculature the potentially injurious compression forces are lessened with the individual either prone or supine. The exercise apparatus 10 is ergonomically and biomechanically designed for maximal strength development of the spinal musculature while guarding for and protecting against unnecessary compression forces through the intervertebral disc. As shown in FIG. 19A the individual begins with slack elastic members with the spinal column horizontal and the upper torso resting on the torso support 200. The individual's feet are firmly secured within the foot ladder 300, as shown in FIG. 19A. The angle of the angled rung support 308 of the foot ladder 300 has been designed to support foot placement with the individual in a supine position as well as a prone position. By lifting the upper torso off the torso support 200, the individual recruits muscles along the posterior surface and length of the spinal column. Although these muscles have individual names, as a whole they are referred to as spinal erectae muscles. The individual can either perform this exercise without resistance or as is shown in FIGS. 19B and 19C, using an elastic member 600 that has been anchored to the midpoint of the lateral base member 212 closest to the torso support wheels 224 of the torso support 200, wherein the elastic member 600 provides resistance to the spinal erectae muscles. FIG. 19C shows the spinal column hyperextended. Note the foundational support the spherical pliable ball 500 offers during this exercise. One can appreciate the role of ball deformation or energy absorption from the ball 500 during this exercise.

Figure 20A:
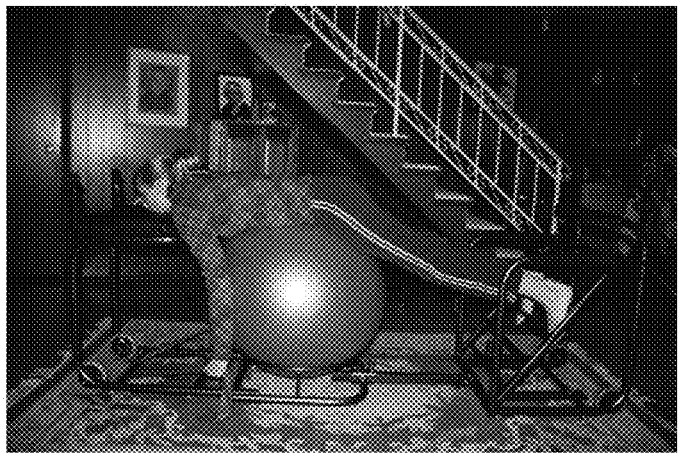
Figure 20B:
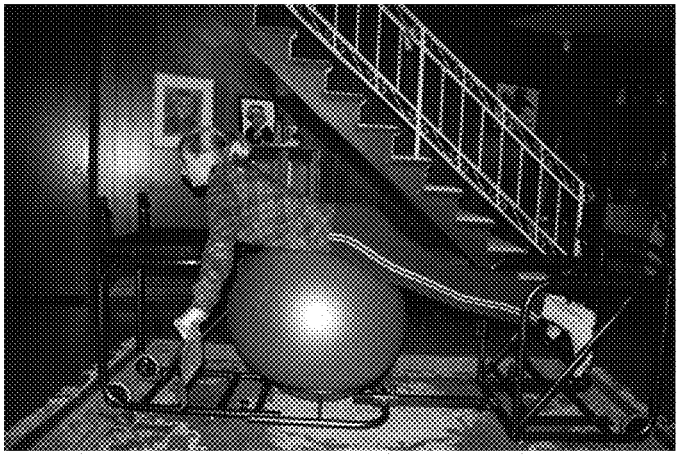
Figure 20C:
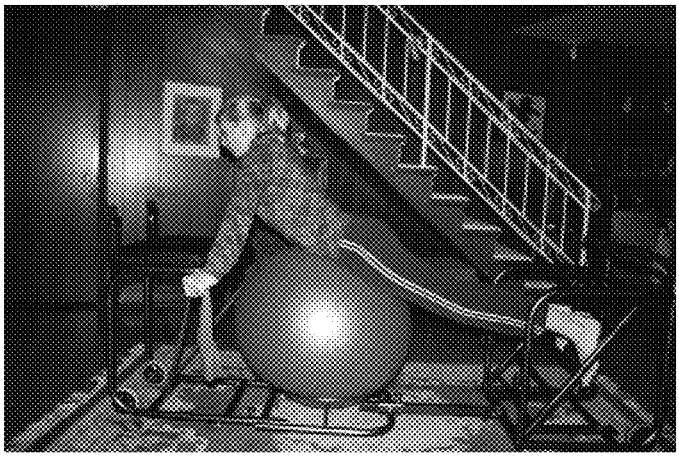

FIGS. 20A, 20B, and 20C show an exercise similar to that of FIGS. 19A, 19B, and 19C, but with an individual securing his or her feet on rungs 310 located higher than the rungs 310 used in that previous exercise. By doing this, different forces are generated through the spinal extensors. This ability to tailor to an exact exercise gives the individual numerous choices to accommodate individual comfort and to facilitate recruitment of spinae erector muscles fibers located at different locations along the spine. In particular, this fine tuning may be used to aid individuals when recuperating from a back injury or dealing with chronic low back pain as they can identify the most therapeutic location upon the foot ladder 300 to place their feet, along with the most therapeutic ball 500 location and elastic member 600 anchoring points. In fact, elastic bands 604 may be secured at a multitude of locations on the torso support 200 to further enhance the broad spectrum of forces that can be transmitted through the posterior spinal musculature. It is important to note that numerous researchers have shown a strong correlation between strength of the spinal extensors and bone mineral density of the vertebral column.

Figure 21A:
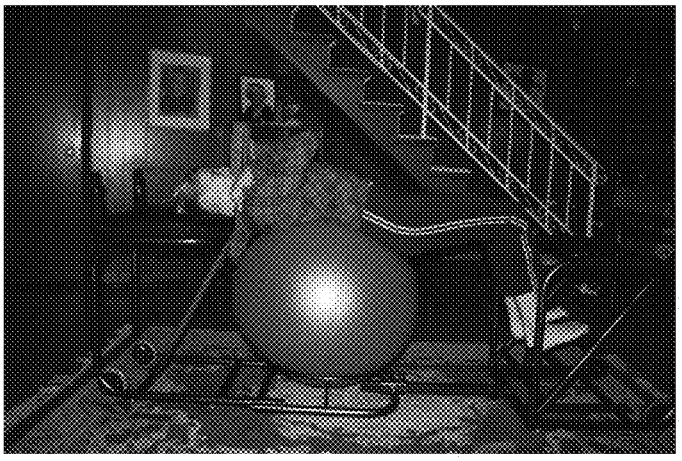
Figure 21B:
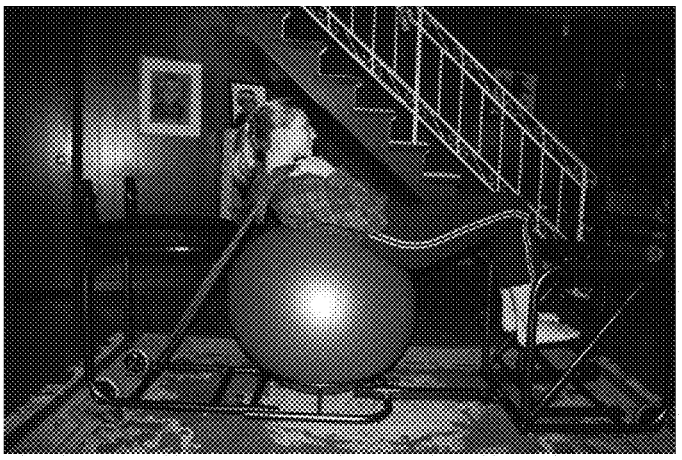
Figure 21C:
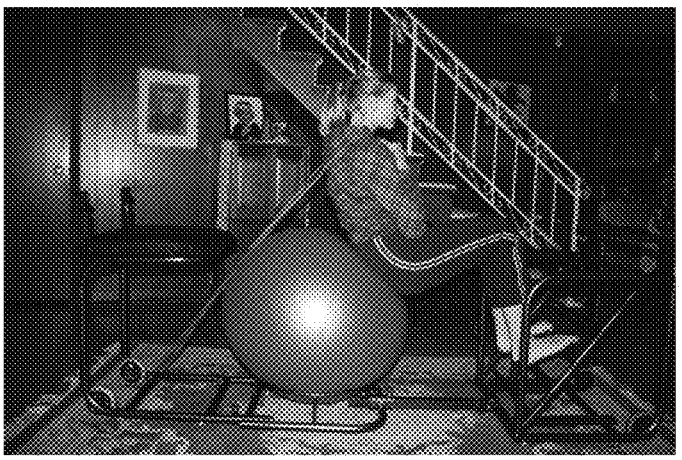

FIGS. 21A, 21B, and 21C show the subject supine on the ball 500 with the vertebral column supported on the ball 500. Again, intervertebral compression forces are minimized with the spinal column horizontal on the ball 500. The broad array of exercises available with the individual in this supine position will cater to the unfit as well as the highly trained individual. Deconditioned individuals may find that unresisted exercises in this position (FIG. 21A) offer sufficient resistive forces in the beginning stages of their individual rehabilitation program. As an individual progresses in strength and fitness, resistance from elastic bands 604 combined with lifting the torso higher off the ball 500, as in FIGS. 21B and 21C, will provide greater forces to the abdominal and lateral belly wall musculature. Primary muscles involved with this exercise include the rectus abdominus, transversus, external obliques and internal obliques. This exercise is commonly called abdominal crunches. By performing this exercise on the ball 500 one gets segmental contraction of these various abdominal muscles. In this exemplary exercise, the elastic bands 604 are attached along the lateral base member 212 closest to the torso support wheels 224 of the torso support 200. The foot ladder 300 provides for optimal biomechanics, as well as user safety.

It is important to note again that the exercise apparatus 10 has physical rehabilitation applications. Individuals receiving physical therapy for back dysfunction are often shown two exercise approaches, McKenzie extension exercises, and Williams flexion exercises. The McKenzie extension exercises are similar to exercises shown in FIGS. 19A, B and C, and the Williams flexion exercises are similar to those shown in FIGS. 21A, B and C.

Figure 22A:
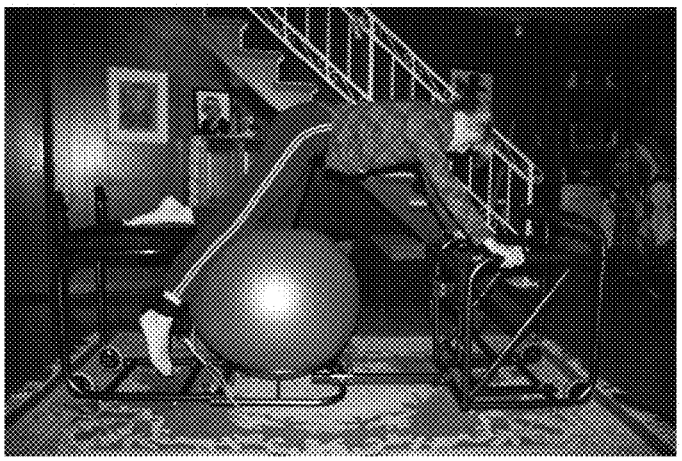
Figure 22B:
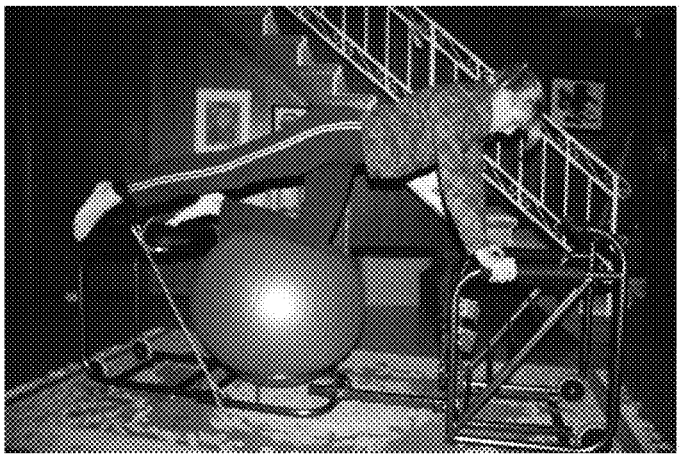
Figure 22C:
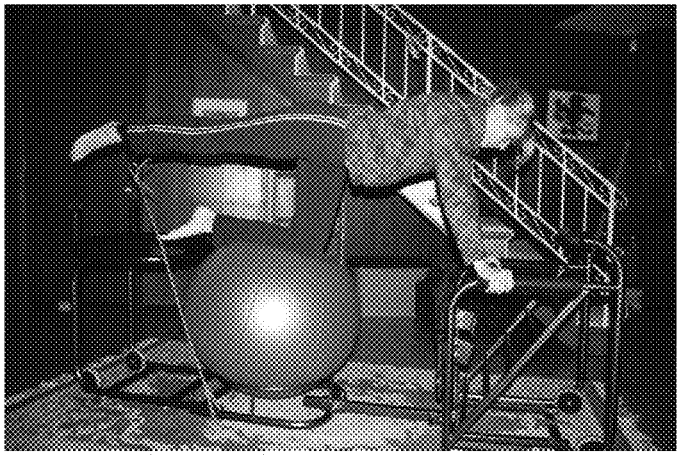

FIGS. 22A, 22B, and 22C show the subject in a prone position with one knee flexed and comfortably positioned on the ball 500, and hands placed on the padded longitudinal top supports 314 of foot ladder 300 with the exercising leg extended. An ankle strap 650 secures an elastic tube 602 from the ankle to the ball support base 102, as shown in the Figures. By taking the leg straight back and up into the air, a motion called hip extension, the individual recruits the gluteus maximus. By lifting the leg higher into the air beyond the horizontal position of the trunk the person hyperextends the hip still recruiting the gluteus maximus. Core stabilization is required and achieved in this position. As the individual takes his or her leg out to the side, a motion called hip abduction, fibers from the gluteus medius are recruited. A 90 degree arch can be achieved by exercising the leg directly backwards to exercising the leg out to the side. Doing so insures recruitment of the posterial and lateral hip prime movers. From the position shown in FIG. 22C with good alignment between the torso and thigh, the individual can flex the knee therefore recruiting the numerous hamstring muscles. The hamstring muscles are composed of the biceps femoris, semimembranosis, and semitendonosis. In this scenario, the posterior and lateral hip musculature engages in proximal stabilization of the hip and thigh so that the hamstring muscles can flex the knee. Without the exercise apparatus 10, this exercise will customarily be done on the floor with both knees bent and hands on the floor. Being on the floor prevents the exercising leg to remain extended throughout the exercise and provides less than optimal exercise of the above mentioned muscles.

An exercise similar to that of FIGS. 22A, 22B, and 22C is one in which the plane of motion of the leg has a larger component that is transverse or lateral to the exercise device 10, so that the leg motion component is out of plane of those figures, and is an example of proximal stabilization with the knee flexion working the hamstrings coupled with hip extension.

Figure 23A:
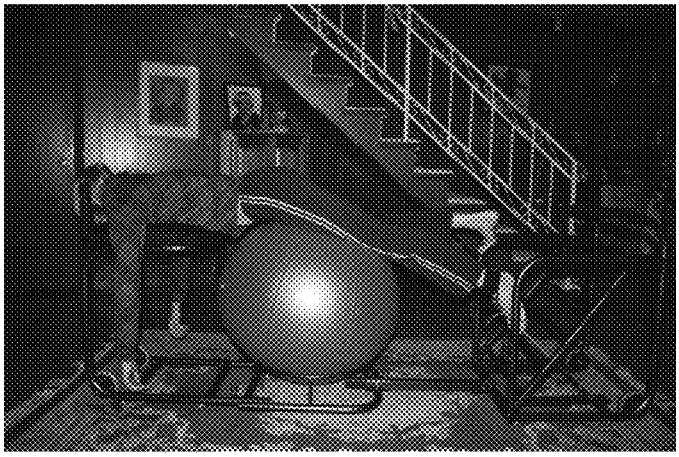
Figure 23B:
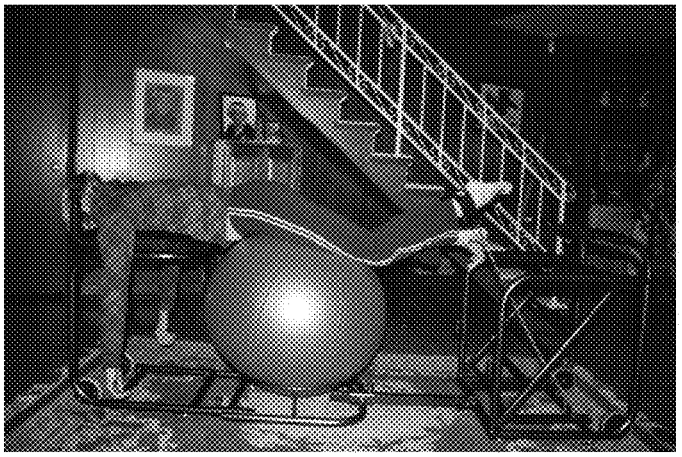
Figure 23C:
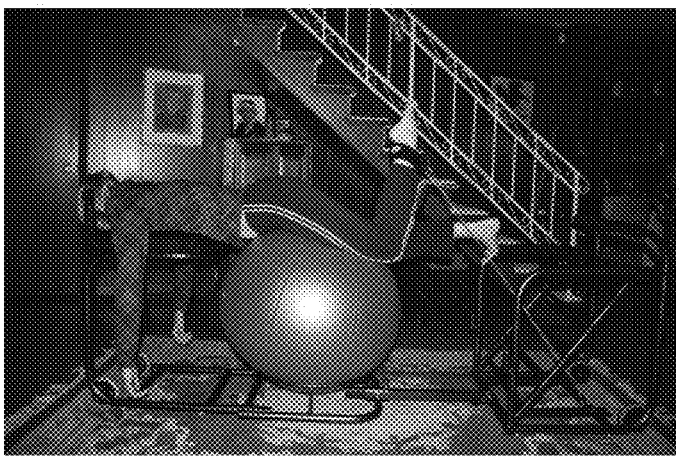

FIGS. 23A, 23B, and 23C show another position for strength training the hamstrings. With this exercise, the individual does not rely on proximal stabilization as the thigh is well supported on the ball 500. This exercise also eliminates the need for core stabilization as the persons torso is supported on the torso support 200. An elastic member 600 comprising an elastic tube 602 transmits forces from an ankle strap 650 secured to the person's ankle to an anchor point on the foot ladder 300. The anchor point shown in these figures, where the left leg is being exercised, is around the junction between the lateral base member 303 and longitudinal nesting foot ramp 338 located on the same side of the foot ladder 300 as the individual's left leg.

Figure 24A:
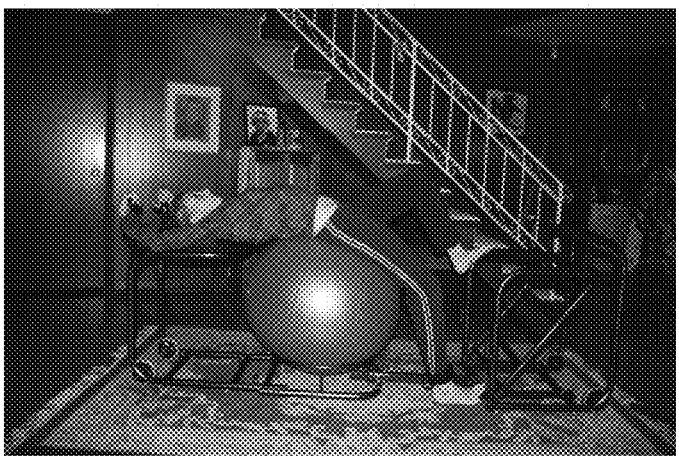
Figure 24B:
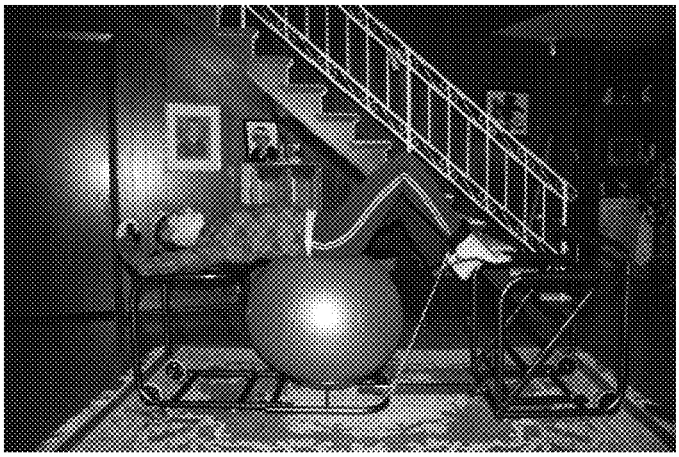
Figure 24C:
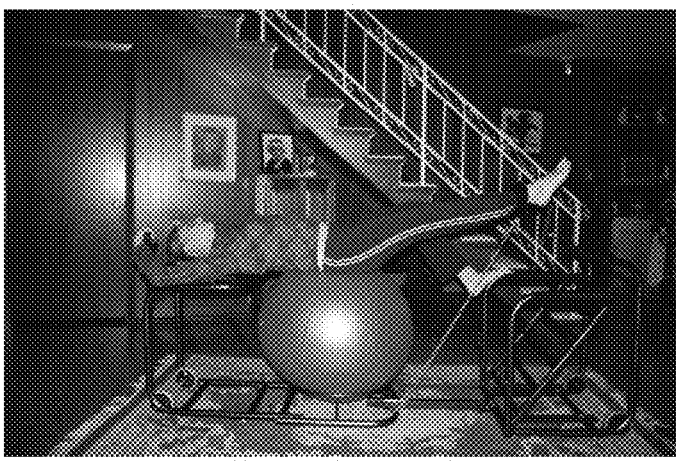

FIGS. 24A, 24B, and 24C show an exercise for strengthening the anterior thigh muscles that is optimal from an ergonomic, biomechanical and kinesiological perspective. The anterior thigh muscles, or quadriceps, are composed of four muscles. One of these four muscles is the rectus femoris. The rectus femoris is a two-joint muscle, as it crosses both the hip and knee joints. In order to most efficiently and optimally strengthen the entire quadricep musculature one needs to begin with hip hyperextension coupled with knee flexion. This fully stretches the origin away from the insertion of the quadriceps. FIG. 24A shows this position. Note that the exercising leg is positioned in hip hyperextension and knee flexion. FIG. 24B shows the progression of hip flexion which recruits fibers from the iliacus and psoas major and minor. The quadriceps femoris also contributes to hip flexion as it crosses the hip joint. As these hip flexors stabilize the hip in flexion, recruitment from the other anterior thigh muscles (vastus lateralis, vastus medialis and rectus femoris) perform knee extension. Resistance is offered through the range of motion shown in FIGS. 24A through 24C by an elastic tube 602, which is attached to an ankle strap 650 around the ankle and anchored to the ball support 100. This motion is very functional and resembles running or kicking a ball. Note the importance of the torso support 200 and handles 204 in this exercise. Note also the contralateral exercising leg (the left leg in the figures) as the foot is supported on the radiused portion of the longitudinal top support 314.

In contrast, standard anterior thigh exercises, done without the exercise apparatus 10, are performed by a seated individual that has his or her knee bent with the resistance over the anterior ankle joint. The anterior thigh is strengthened in this case by lifting the foot into the air, thus straightening out the knee. There is little if any hip hyperextension coupled with this knee flexion in the standard anterior thigh exercise. Consequently the standard exercise is less beneficial than the exercise of FIGS. 24A through 24C.

The above exemplary exercise regimens are meant to show the potential embodiments of the exercise apparatus 10 in working and exercising most muscle groups in the human body, in a comfortable, well supported, safe manner. There are numerous other exercises that can be done with the exercise apparatus 10. It is recommended that anyone intending to undertake exercise first consult a physician for advice concerning an appropriate level of exertion for his or her level of health and fitness.

It should be understood that even though these numerous characteristics and advantages of various embodiments have been set forth in the foregoing description, together with details of the structure and function of the embodiments, the disclosure is illustrative only, and changes may be made in detail, especially in matters of shape, size and arrangement of parts within the principals of the claimed embodiments in the appended claims to the full extent indicated by the broad general meaning of the terms in that the appended claims are expressed.

What is claimed is:

1. An exercise apparatus, comprising:

a ball support configured to receive an elastic ball;

a foot ladder configured to receive one or more feet of a user, wherein the foot ladder has a rigid rectangular base, wherein the foot ladder is attached to one end of the ball support, and wherein the foot ladder is configured to provide support to the user during exercise;

a torso support, wherein the torso support has a rigid rectangular base, and wherein the torso support is configured to support the torso of the user during exercise, wherein the torso support is attached to another end of the ball support, wherein the ball support, the foot ladder, and the torso support are configured to nest within one another for storage; and a detachable support reversibly connected to the foot ladder, wherein the detachable support is configured to hold the ball support within an envelope of the foot ladder after ball support pivoting.

2. The exercise apparatus of claim 1, further comprising:

an elastic ball that rests upon the ball support, wherein the elastic ball is configured to support the user, wherein the ball support is rigid and prevents rotation of the elastic ball, wherein the exercise apparatus has a bottom surface; and a horizontal torso support top of the torso support, configured to comfortably support the torso of a user, wherein the vertical location of the horizontal torso support top of the torso support is located from 1 to 5 inches below the vertical location of the uppermost tangent of the elastic ball, where the vertical locations are measured upwardly from the bottom surface of the exercise apparatus.

3. The exercise apparatus of claim 2, wherein the foot ladder has rungs attached to an angled rung support, wherein the angled rung support is angled upward and away from the ball support and is configured to provide ergonomic support to a user that interfaces with the ball in a variety of positions.

4. The exercise apparatus of claim 1 claim, wherein the foot ladder further comprises circular rollers for transporting the nested exercise apparatus.

5. The exercise apparatus of claim 1, wherein the ball support is pivotally connected to the foot ladder.

6. The exercise apparatus of claim 1, wherein the detachable support is configured to rigidly fix the feet of the user in place through the use of a foot plate and a corresponding shin support bar.

7. The exercise apparatus of claim 1, further comprising:

a torso support adjustment mechanism, wherein the distance between the torso support and the ball support is easily adjustable, and a foot ladder adjustment mechanism, wherein the distance between the ball support and the foot ladder is easily adjustable.

8. The exercise apparatus of claim 1, wherein the torso support further comprises upright handles configured to provide torsional resistance to body rotation during exercise.

9. An exercise apparatus, comprising:

a ball support configured to receive an elastic ball;

a foot ladder configured to receive one or more feet of a user, wherein the foot ladder is attached to one end of the ball support and has a rigid box-like structure, configured to provide support to the user during exercise;

a torso support having a rigid box-like structure, configured to support the torso of the user during exercise, wherein the torso support is attached to another end of the ball support, wherein the foot ladder has a rigid rectangular base frame, and wherein the torso support has a rigid rectangular base frame.

10. The exercise apparatus of claim 9, wherein the angle between a longitudinal base member of the foot ladder and an angled rung support of the foot ladder is preferably between 30 and 50 degrees.

11. The exercise apparatus of claim 9, further comprising:

a pair of gloves around which the elastic member may be wrapped for exercise, wherein the gloves are padded, and wherein the gloves have a coefficient of friction that prevents slippage of the elastic member.

12. A system for exercising, comprising:

means for receiving an elastic exercise ball;

torso supporting means, wherein the torso supporting means are configured to support a user's body weight, and wherein the torso supporting means comprise a horizontal surface that is configured to be substantially coplanar with an upper portion of an elastic ball that has been deformed under the weight of a user; and foot restraint means, wherein the foot restraint means are configured to restrain a user's feet at each of a plurality of degrees of knee bend, wherein the means for receiving an elastic ball are pivotally connected to the foot restraint means, wherein the means for receiving the elastic exercise ball and the torso supporting means are configured to nest within the foot restraint means for storage, and wherein the system further comprises retaining means for fixing the elastic ball receiving means within an envelope of the foot restraint means after pivoting the elastic ball receiving means.

13. The exercise apparatus of claim 12, further comprising transportation means for transporting the nested system for storage.

14. The exercise apparatus of claim 12, further comprising:

elastic resistance means configured to exercise a user, and means for selectively connecting the elastic resistance means to the torso supporting means and the foot restraint means, to provide a resistance force in a resistance direction.

15. The exercise apparatus of claim 4, wherein the torso support further comprises circular rollers for transporting the torso support.

* * * * *